US012258762B2

(12) United States Patent
Garrison et al.

(10) Patent No.: US 12,258,762 B2
(45) Date of Patent: Mar. 25, 2025

(54) ASSEMBLY STRUCTURE FOR TENT AND VARIABLY EXPANDABLE OUTDOOR TENT

(71) Applicant: Zhejiang Yotrio Group Co., Ltd., Zhejiang (CN)

(72) Inventors: Scott Adam Garrison, Fitchburg, WI (US); Yingju Sun, Zhejiang (CN); Jiehua Chu, Zhejiang (CN); Jianqiang Xie, Zhejiang (CN)

(73) Assignee: Zhejiang Yotrio Group Co., Ltd., Zhejiang (CN)

( * ) Notice: Subject to any disclaimer, the term of this patent is extended or adjusted under 35 U.S.C. 154(b) by 0 days.

(21) Appl. No.: 18/274,855

(22) PCT Filed: Aug. 10, 2022

(86) PCT No.: PCT/CN2022/111336
§ 371 (c)(1),
(2) Date: Jul. 28, 2023

(87) PCT Pub. No.: WO2023/016478
PCT Pub. Date: Feb. 16, 2023

(65) Prior Publication Data

US 2024/0093502 A1 Mar. 21, 2024

(30) Foreign Application Priority Data

Aug. 11, 2021 (CN) ..... 202121867751.5

(51) Int. Cl.
*E04F 10/02* (2006.01)
*E04F 10/08* (2006.01)

(52) U.S. Cl.
CPC ..... *E04F 10/02* (2013.01); *E04F 10/08* (2013.01)

(58) Field of Classification Search
CPC ..... E04H 15/34; E04H 15/008; E04H 15/18; E04H 15/58; E04H 1/1205; E04F 10/02; E04F 10/08
See application file for complete search history.

(56) References Cited

U.S. PATENT DOCUMENTS 3,451,183 A * 6/1969 Lespagnol ..... E06B 3/968 52/656.1
3,559,357 A * 2/1971 Lowe ..... E04B 1/18 52/656.1

(Continued)

FOREIGN PATENT DOCUMENTS

AU 2018223297 A1 9/2019
CN 207160735 U 3/2018

(Continued)

OTHER PUBLICATIONS

China National Intellectual Property Administration, International Search Report, Application No. PCT/CN2022/111336, mailed Nov. 8, 2022, 4 pages.

(Continued)

*Primary Examiner* — Gisele D Ford
(74) *Attorney, Agent, or Firm* — Ziegler IP Law Group LLC.

(57) ABSTRACT

The present invention discloses an assembly structure for a tent and a variously expandable outdoor tent. The assembly structure includes stand columns (1) and ring beams (2), where the stand column (1) and the ring beam (2) are each provided with an assembly slot (4), and the stand columns (1) and the ring beams (2) can be assembled by using first connection components to form a tent frame (7); further includes a canopy (3) configured to be cooperatively mounted with the tent frame (7), where the tent frame (7) includes at least one tent frame unit (71), and a single canopy (3) is cooperatively disposed in a single tent frame unit (71);

(Continued)

and further includes at least one expansion unit (8), where the expansion unit (8) is cooperatively mounted with an assembly slot (4) by using a third connection component (9). In the present invention, the assembly slot (4) structures are optimally designed, and are combined on the stand columns (1) and the ring beams (2). In addition, by using different connection components and cooperation relationships with the assembly slots (4), the stand columns (1) and the ring beams (2) can be combined and mounted quickly, the ring beam (2) components can also be docked and mounted, and different expansion units (8) can be combined and mounted, to assemble tents with different functions.

19 Claims, 19 Drawing Sheets

(56) References Cited

U.S. PATENT DOCUMENTS 3,566,561 A * 3/1971 Tozer ..... F16B 12/50 D25/123
3,715,849 A * 2/1973 Strassle ..... E04B 1/24 52/646
3,901,612 A * 8/1975 Canin ..... F16B 12/32 403/231
4,035,972 A * 7/1977 Timmons ..... E04B 2/7425 52/36.6
4,071,990 A * 2/1978 Traber ..... E04B 2/7453 403/231
4,432,590 A * 2/1984 Lawrence ..... A47B 47/04 403/231
4,490,064 A * 12/1984 Ducharme ..... F16B 7/0466 403/255
4,607,754 A * 8/1986 Wolf ..... A47B 57/408 211/183
4,619,547 A * 10/1986 Renaud-Goud ..... A47B 57/54 403/231
4,652,170 A * 3/1987 Lew ..... F16B 12/02 403/171
4,796,391 A * 1/1989 Lu ..... E04B 7/024 52/73
4,841,688 A * 6/1989 Rinaldi ..... E04H 15/322 52/63
5,481,842 A * 1/1996 Gautreau ..... E04B 2/76 403/231
5,685,662 A * 11/1997 Rollin ..... E04B 2/766 403/231
5,848,500 A * 12/1998 Kirk ..... E04B 1/5831 403/231
6,192,643 B1 * 2/2001 Zadok ..... E04H 3/16 52/DIG. 17
6,338,226 B1 * 1/2002 Gauthier ..... E04B 1/0046 52/273
6,682,255 B2 * 1/2004 Battaglia ..... A47F 5/14 403/381
7,845,139 B1 * 12/2010 Mansueto ..... E06B 3/9681 52/745.15
7,963,072 B2 * 6/2011 Anderson ..... E04H 1/12 52/79.12
8,292,380 B2 * 10/2012 Fan ..... H05K 7/183 403/217
8,708,169 B1 * 4/2014 Chen ..... F16B 7/187 403/252
8,992,110 B2 * 3/2015 Decroos ..... F16B 5/0008 403/292
9,243,422 B2 * 1/2016 Hunt ..... E04H 15/18
9,476,441 B2 * 10/2016 Strassle ..... F16B 7/0446
9,556,639 B2 * 1/2017 Hunt ..... E04H 15/02
10,202,783 B2 * 2/2019 Pan ..... E04H 15/58
10,368,499 B1 * 8/2019 Lin ..... E04B 1/1903
10,724,267 B2 * 7/2020 Amadardo ..... A47B 47/0016
10,760,296 B2 * 9/2020 Zhu ..... B41F 16/0073
2020/0199863 A1 * 6/2020 Binder ..... E04B 9/065
2020/0399905 A1 * 12/2020 Pan ..... E04H 15/54
2021/0396038 A1 * 12/2021 Chu ..... E04H 15/60

FOREIGN PATENT DOCUMENTS

CN 210918456 U 7/2020
CN 211874082 U 11/2020
CN 212002615 U 11/2020
CN 212957965 U 4/2021
CN 217001180 U 7/2022
JP 2009257080 A 11/2009

OTHER PUBLICATIONS

State Intellectual Property Office of China, Written Opinion, Application No. PCT/CN2022/111336, mailed Nov. 8, 2022, 5 pages.
State Intellectual Property Office of China, Written Opinion, Application No. PCT/CN2022/111336, mailed Nov. 8, 2022, English Translation, 6 pages.
European Patent Office, Communication Pursuant to Rule 161(1) EPC, Application No. 22855459.8-1005 / 4321709 PCT/CN2022111336, Dated Oct. 29, 2024, 15 Pages.

* cited by examiner

ASSEMBLY STRUCTURE FOR TENT AND VARIABLY EXPANDABLE OUTDOOR TENT

FIELD OF TECHNOLOGY

The present invention relates to the field of outdoor product technologies, and in particular to an assembly structure for a tent and a variously expandable outdoor tent.

BACKGROUND

Outdoor tents are sheds that are supported on the ground to perform shielding from wind, rain and sunlight and are used for temporary living. The outdoor tent generally includes a canopy structure and a tent frame structure. The tent frame is usually formed by four stand columns and the ring beams connecting the four stand columns. Due to the different specifications of the tents, the ring beam may be formed by spliced ring beams or a single ring beam. For the packaging and transportation of the tent, especially, the tent frame is usually designed to be assemblable.

Therefore, the connection structure configured to connect the ring beams, stand columns, and other components is particularly important. However, the existing connection structure is complicated to assemble and the connection structure limits the existing mounted structure. As a result, the entire tent frame cannot be variously expanded, with great limitations.

SUMMARY

To resolve the foregoing problem, the present invention provides an assembly structure for a tent and a variously expandable outdoor tent. The stand columns and the ring beam structures are optimized. By using the assembly slots, different components can be combined and mounted variously, improving the performance of the product and enriching the diversification of the product.

The technical problem of the present invention can be resolved by using the following technical solution:

An assembly structure for a tent includes stand columns and ring beams, where the stand column and the ring beam are each provided with an assembly slot, the stand columns and the ring beams can be assembled by using first connection components to form a tent frame, the first connection component includes a first connection component unit configured to be cooperatively mounted with the assembly slot in the stand column, a second connection component unit configured to be cooperatively mounted with the assembly slot in the ring beam, and a third connection component unit configured to dock the first connection component unit and the second connection component unit.

The assembly slot includes a slot cavity and an open slot penetrating through the slot cavity, limiting plates are disposed at two sides of the open slot, and a part of the slot cavity adjacent to the open slot is wider than the open slot.

The first connection component includes a plurality of fastening insert members and assembly members, the fastening insert member is configured to match with the assembly slot, the fastening insert member includes a fastening insert part and a fixing part, the fastening insert part is configured to match with the slot cavity, the fixing part is configured to match with the open slot, an outer surface of the fixing part is provided with a fixed hole, the fastening insert member in the first connection component unit is configured to match with the assembly slot in the stand column, the fastening insert member in the second connection component unit is configured to match with the assembly slot in the ring beam, and the third connection component unit is configured to perform cooperative mounting with the fastening insert members.

The assembly member includes a ring-beam inner liner, a first anchor member, and a second anchor member, the ring-beam inner liner is embedded and mounted at one end of the ring beam, the first anchor member is embedded and mounted in the ring-beam inner liner, an anchor head protrudes from an end face of the ring-beam inner liner, the anchor head is configured to be cooperatively embedded with the assembly slot, an inner limit hole is provided on the ring-beam inner liner, an outer limit hole corresponding to the inner limit hole is disposed on the ring beam, and the second anchor member is configured to penetrate through the outer limit hole and the inner limit hole, to match with the first anchor member.

The connection component unit 3 includes an angle-iron member, an upper end face and a side end face of the angle-iron member match with fixing parts respectively, and the fixing parts are a fixing part on a fastening insert member configured to be cooperatively mounted with the ring beam and a fixing part on a fastening insert member configured to be cooperatively mounted with the stand column, respectively.

The connection component unit 3 includes a reinforcing rod, two ends of the reinforcing rod are configured to be cooperatively mounted with fixing parts respectively, and the fixing parts located at the two ends are, respectively, fixing parts on fastening insert members correspondingly mounted on upper surfaces of two adjacent ring beams in cooperation at two sides of the stand column.

A top of the stand column is cooperatively provided with a stand column inner liner, the stand column inner liner is configured to be embedded in a stand column inner cavity, and an upper surface of the stand column inner liner is provided with an end cover plate.

The ring beam located between two adjacent stand columns is formed by docking two ring beam units, the ring beam units are cooperatively mounted by using a second connection component, the second connection component includes a docking fastening insert member, a reinforcing plate, and a docking ring-beam inner liner, the docking fastening insert member includes a docking fastening insert part and a docking fixing part, the docking fastening insert part is configured to match with the slot cavity, the docking fixing part is configured to match with the open slot, an outer surface of the docking fixing part is provided with a docking fixing hole, the docking fixing hole is configured to match with the reinforcing plate, a fastener is configured to realize reinforcing and fixing, the docking ring-beam inner liner is divided into two symmetrical parts, and the two parts are embedded in inner cavities of two docked ring beam units respectively.

The docking fastening insert member is configured to be cooperatively mounted with adjacent docked ring beams, and the docking fastening insert member is symmetrically mounted in assembly slots of two adjacent docked ring beams.

A variously expandable outdoor tent based on an assembly structure for a tent includes the tent frame described above, and a canopy configured to be cooperatively mounted with the tent frame.

The tent frame includes at least one tent frame unit, and a single canopy is cooperatively disposed in a single tent frame unit.

The canopy includes one or more of a tarpaulin canopy, a louver canopy, a tin canopy, a sun panel canopy, an umbrella canopy, and an inclined canopy.

Two or more tent frame units are provided, and ring beams, at a same side, of two adjacent tent frame units are cooperatively mounted by using a same stand column.

The variously expandable outdoor tent based on an assembly structure for a tent further includes at least one expansion unit, where the expansion unit is cooperatively mounted with an assembly slot by using a third connection component.

The third connection component includes a clamping member, and the expansion unit is cooperatively fixed to a fixing part on the clamping member by using a fastener.

The expansion unit includes a sunshade shutter, the expansion unit is cooperatively mounted with an assembly slot below the ring beam by using the third connection component, and the expansion unit is hanged below the ring beam.

The expansion unit includes a sun-shedding louver, the sun-shedding louver is cooperatively mounted with the assembly slot below the ring beam by using the third connection component, and the sun-shedding louver is hanged below the ring beam.

The expansion unit includes a grille assembly, and the grille assembly is cooperatively mounted with an assembly slot on a stand column by using the third connection component.

A table board is cooperatively disposed on an upper part of the grille assembly, and at least one side of the table board is cooperatively mounted with the assembly slot on the stand column by using the third connection component.

The expansion unit includes a stool chair, and the stool chair is cooperatively mounted with the assembly slot on the stand column by using the third connection component.

The expansion unit includes a decorative panel, and the decorative panel is integrally or separately fixed to the third connection component and is cooperatively mounted with the assembly slot of the stand column.

Compared with the related art, the present invention has the following beneficial effects, the assembly slot structures are optimally designed, and are combined on the stand columns and the ring beams. In addition, by using different connection components and cooperation relationships with the assembly slots, the stand columns and the ring beams can be combined and mounted quickly, the ring beam components can also be docked and mounted, and different expansion units can be combined and mounted, to assemble tents with different functions.

The features of the present invention can be clearly understood from the description of the drawings and the detailed description of the preferable embodiments.

DESCRIPTION OF THE EMBODIMENTS

Figure 1:
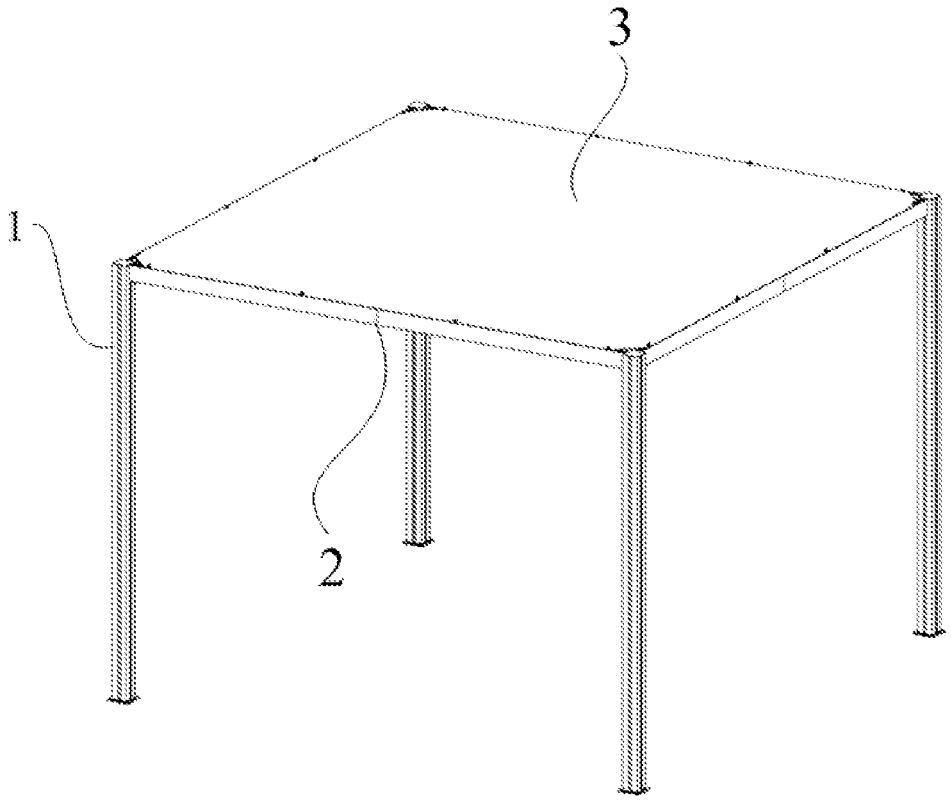
FIG. 1 is a schematic diagram 1 of an entire structure of an outdoor tent according to the present invention.

In order to make the technical means, creative features, achievement goals and effects achieved by the present invention easy to understand, the present invention is further described below in conjunction with specific illustrations.

It should be noted that all the directional indications (for example, up, down, left, right, front, and back) in the embodiments of the present invention are only used to explain the relative positional relationship, motion situation, and the like between the components at a specific angle (as shown in the drawings). If the specific angle changes, the directional indications also change accordingly. In addition, the descriptions of "first", "second" and the like in the present invention are used for the purpose of description only, and are not to be construed as indicating or implying their relative importance or implicitly indicating the number of technical features indicated. Thus, a feature defined by "first" or "second" may explicitly or implicitly includes at least one of the features.

Embodiment 1

With reference to FIGS. 1 to 32, this embodiment discloses an assembly structure for a tent, including stand columns 1 and ring beams 2. In some embodiments, the stand column 1 or the ring beam 2 is correspondingly provided with an assembly slot 4 for the mounting purpose. In a preferable embodiment, the stand column 1 and the ring beam 2 are each provided with the assembly slot 4. The stand column 1 and the ring beam 2 can be assembled by using a first connection component 5 to form a tent frame 7. The first connection component 5 includes a first connection component unit configured to be cooperatively mounted with the assembly slot 4 in the stand column 1, a second connection component unit configured to be cooperatively mounted with the assembly slot 4 in the ring beam 2, and a third connection component unit configured to dock the first connection component unit and the second connection component unit. Preferably, the tent frame 7 includes four stand columns 1 and four ring beams 2 mounted between upper parts of adjacent stand columns 1. In the other embodiments, the tent frame 7 may include more stand columns 1 and the ring beams 2 correspondingly.

Figure 3:
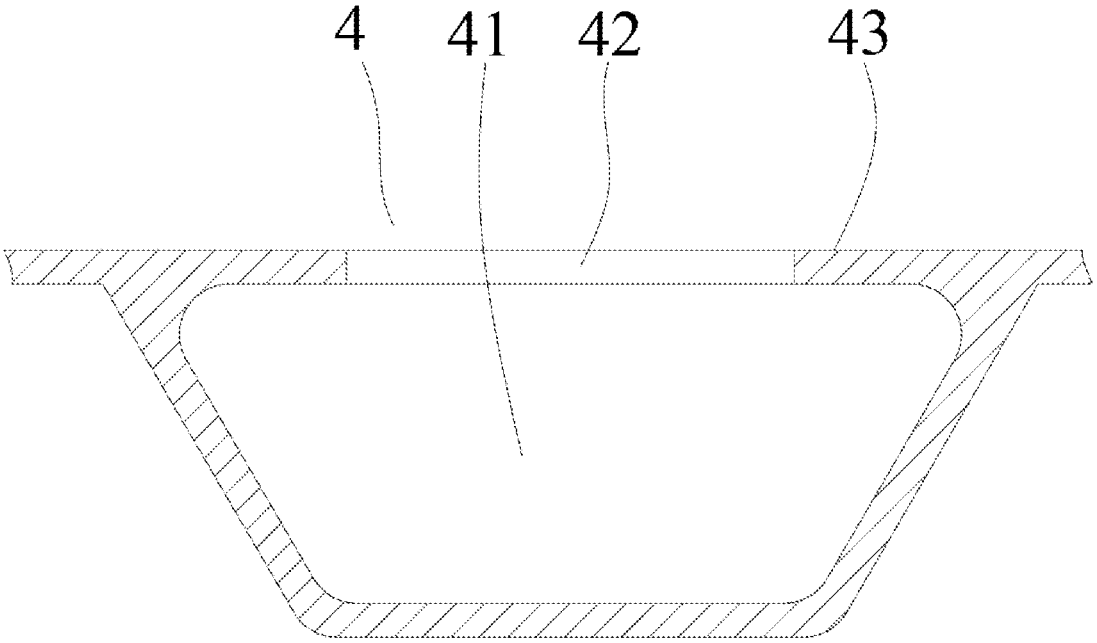
FIG. 3 is a schematic sectional view of an assembly slot according to the present invention.
Figure 4:
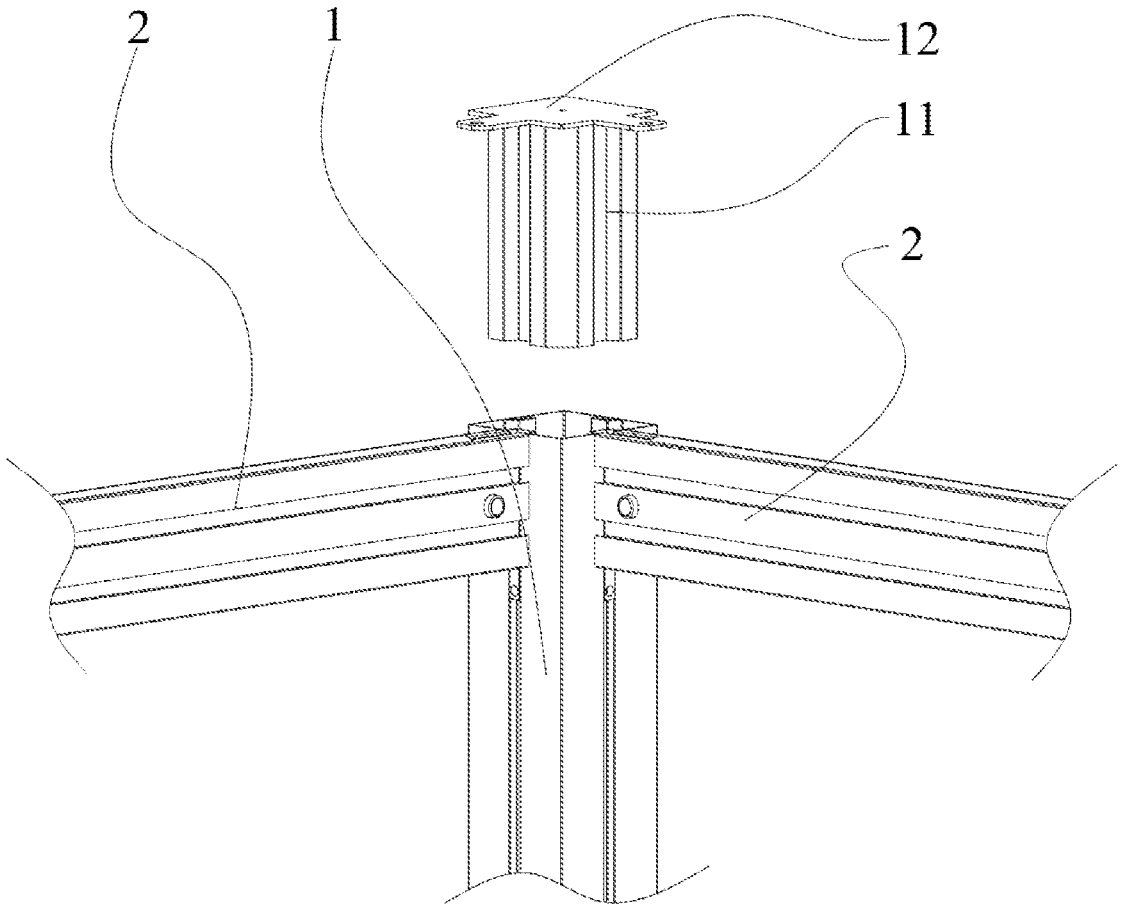
FIG. 4 is a schematic structural diagram 1 of a mounted structure of a stand column and ring beams according to the present invention.
Figure 5:
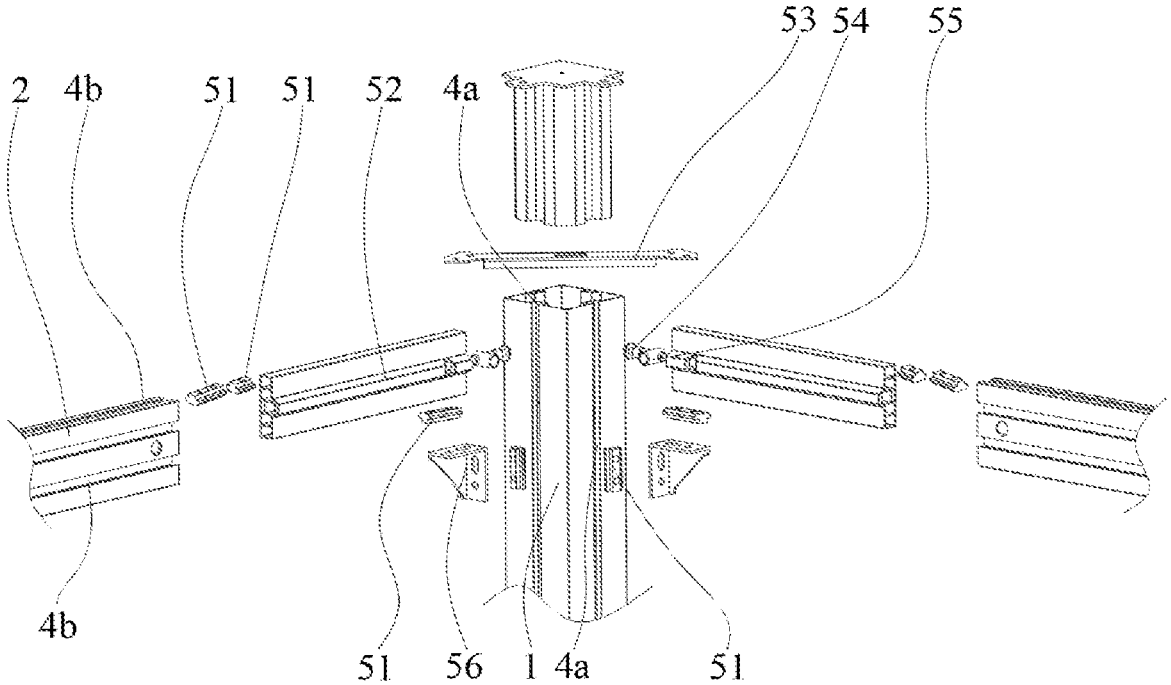
FIG. 5 is a schematic structural diagram 2 of the mounted structure of the stand column and ring beams according to the present invention.
Figure 6:
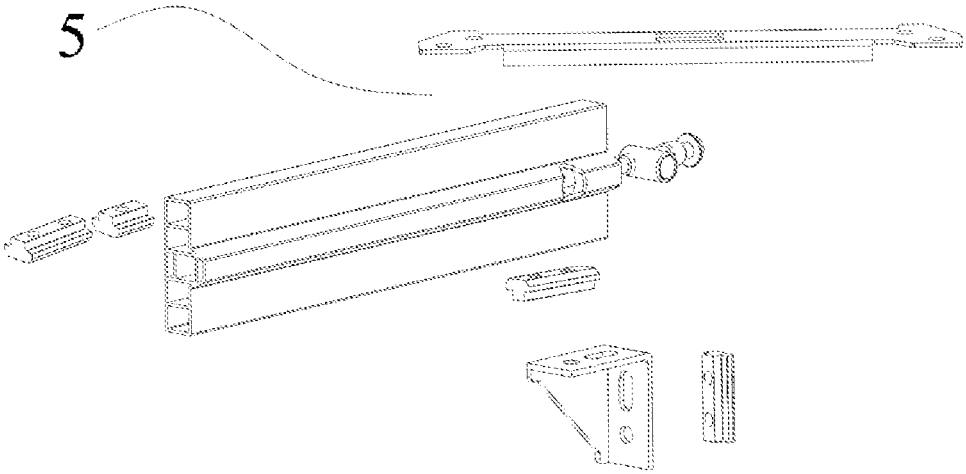
FIG. 6 is a schematic structural diagram of a first connection component according to the present invention.
Figure 7:
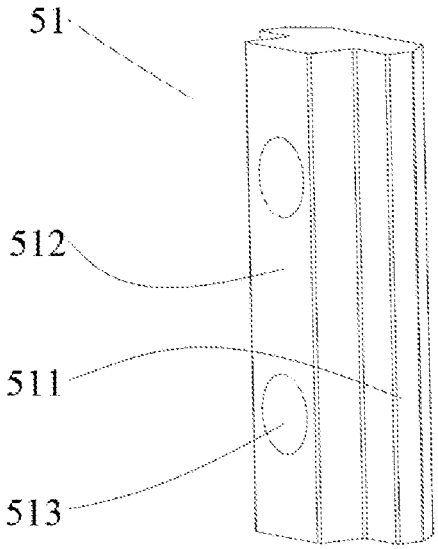
FIG. 7 is a schematic structural diagram of a fastening insert member according to the present invention.
Figure 8:
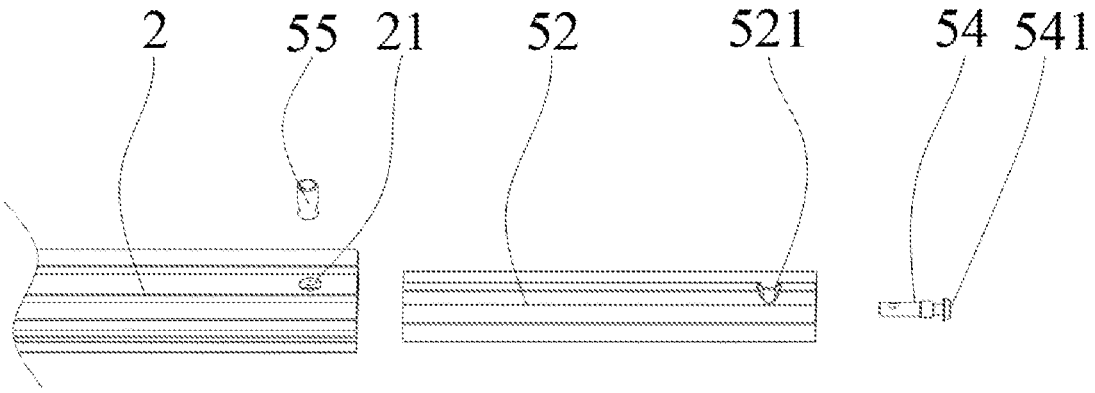
FIG. 8 is a schematic structural diagram 1 of a mounted structure of the ring beam and an assembly member according to the present invention.
Figure 9:
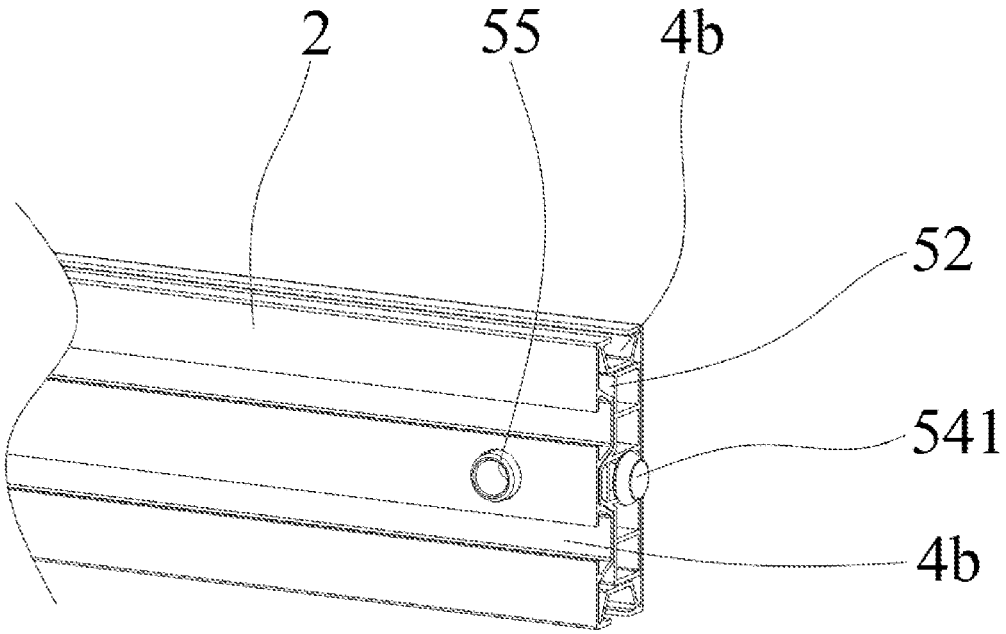
FIG. 9 is a schematic structural diagram 2 of the mounted structure of the ring beam and the assembly member according to the present invention.
Figure 10:
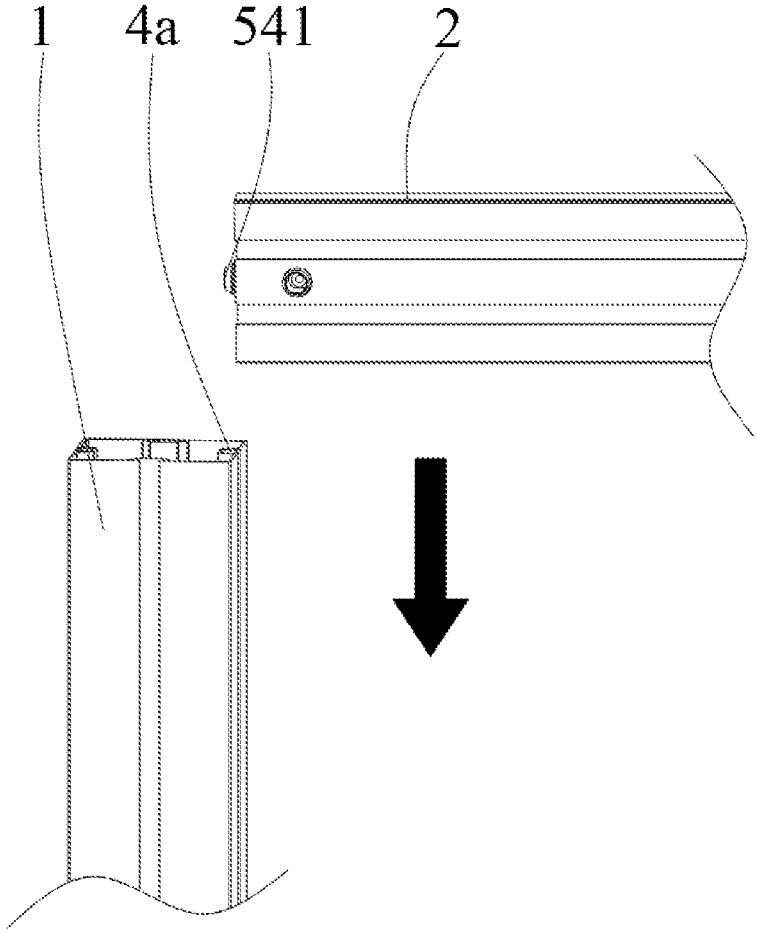
FIG. 10 is a schematic structural diagram 3 of the mounted structure of the stand column and the ring beams according to the present invention.
Figure 11:
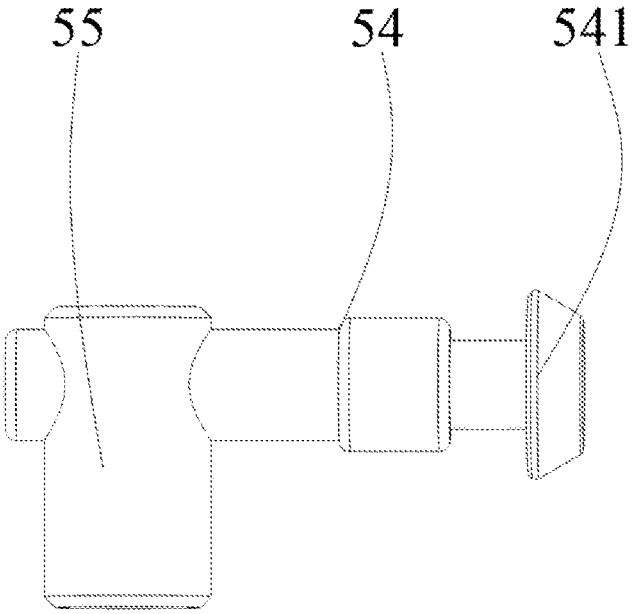
FIG. 11 is a schematic structural diagram of a cooperatively mounted structure of a first anchor member and a second anchor member according to the present invention.
Figure 12:
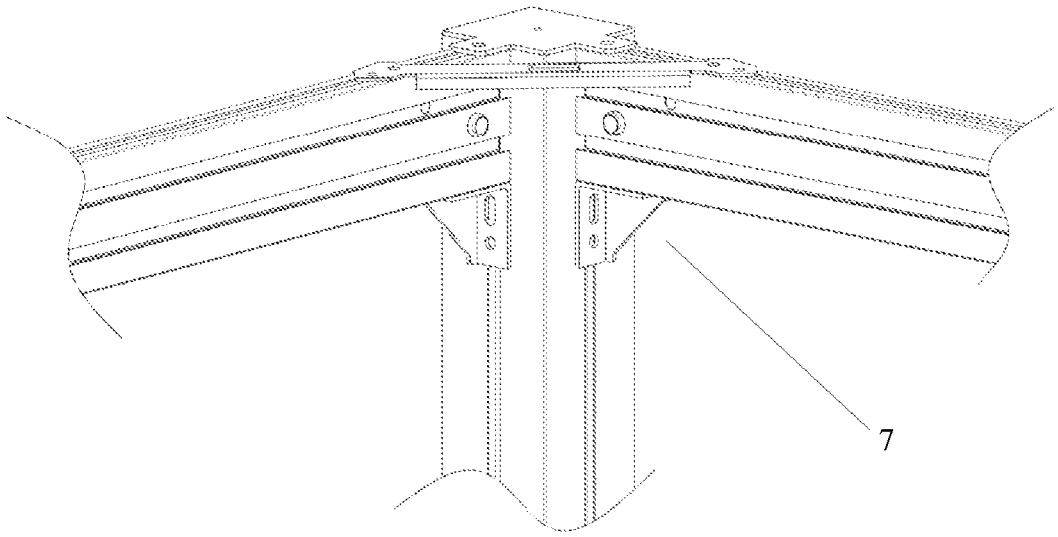
FIG. 12 is a schematic structural diagram 4 of the mounted structure of the stand column and the ring beams according to the present invention.
Figure 13:
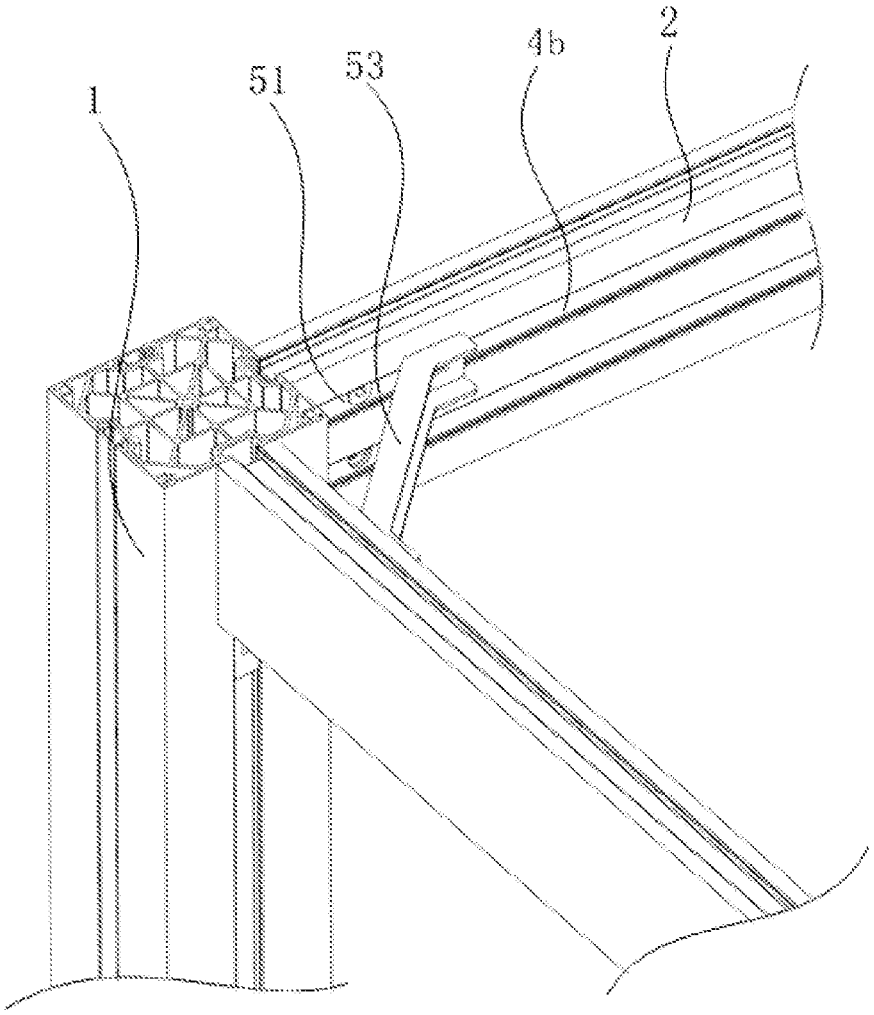
FIG. 13 is a schematic structural diagram 5 of the mounted structure of the stand column and the ring beams according to the present invention.
Figure 14:
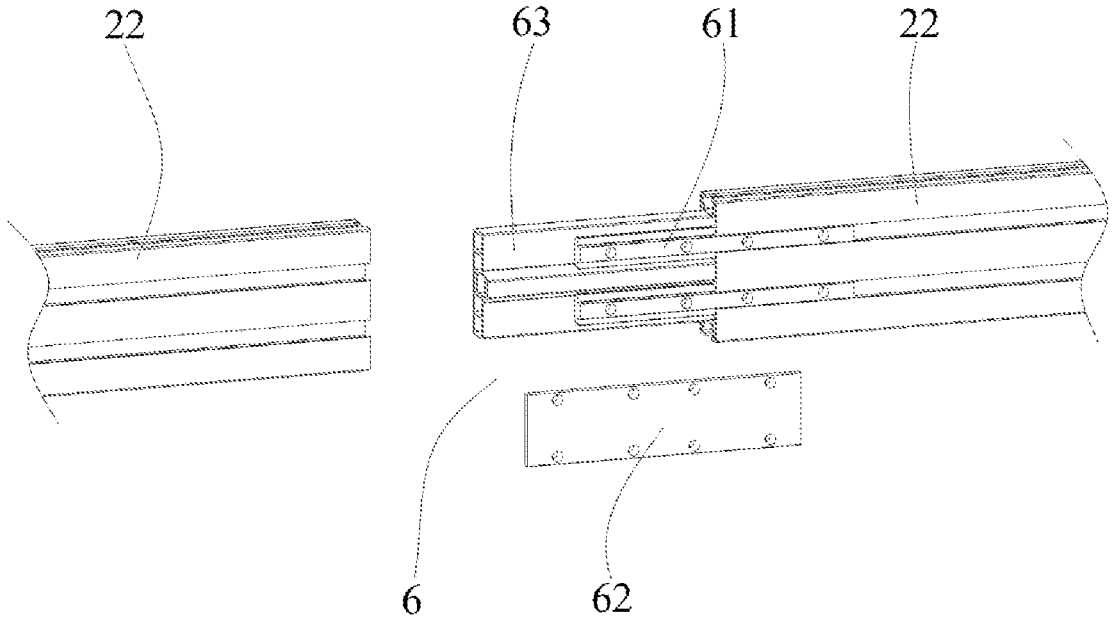
FIG. 14 is a schematic structural diagram 1 of a mounted structure of the ring beams according to the present invention.
Figure 15:
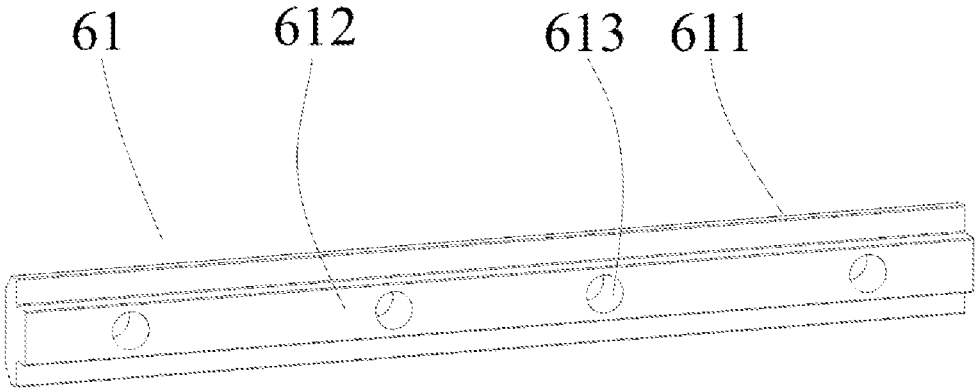
FIG. 15 is a schematic structural diagram of a docking fastening insert member according to the present invention.
Figure 16:
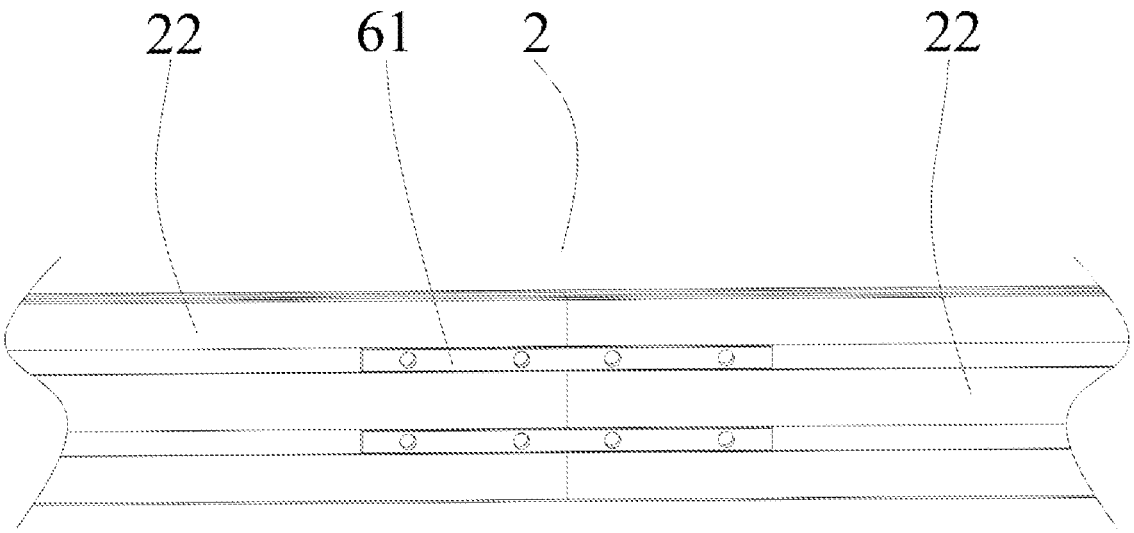
FIG. 16 is a schematic structural diagram 2 of the mounted structure of the ring beams according to the present invention.

As shown in FIG. 3, the assembly slot 4 includes a slot cavity 41 and an open slot 42 penetrating through the slot cavity 41. Limiting plates 43 are disposed at two sides of the open slot 42 respectively. The limiting plate 43 is configured to prevent the disengagement of a fastening insert member 51. A part of the slot cavity 41 adjacent to the open slot 42 is wider than the open slot 42. In a specific structure, the slot cavity 41 is preferably of a dovetail groove structure. The cross-sectional shape of the slot cavity 41 is similar to an isosceles trapezoid. Corners are set with arc transitions. The long side of the slot cavity 41 is adjacent to the open slot. The limiting plate 43 extends. The assembly slot 4 is disposed on the stand column 1 or the ring beam 2 along the length direction, and the head and the tail communicate.

The assembly slots 4 in different components are marked with different serial numbers in the accompanying drawings, such as the assembly slot 4*a* in the stand column 1 and the assembly slot 4*b* in the ring beam 2. Because the formed structures or matching components are different to some extent, the assembly slots 4 are in a same slot shape, but can have different specific sizes, especially, the lengths, which can be correspondingly selected according to different components. In some embodiments, the assembly slots 4 may have a same size. In some other embodiments, the assembly slots 4 may have different sizes. In addition, because the assembly slots 4*b* are in different surfaces of the ring beam 2 and need to be correspondingly mounted with different components, the sizes of these assembly slots 4 may be adjusted separately according to the requirements.

Figure 2:
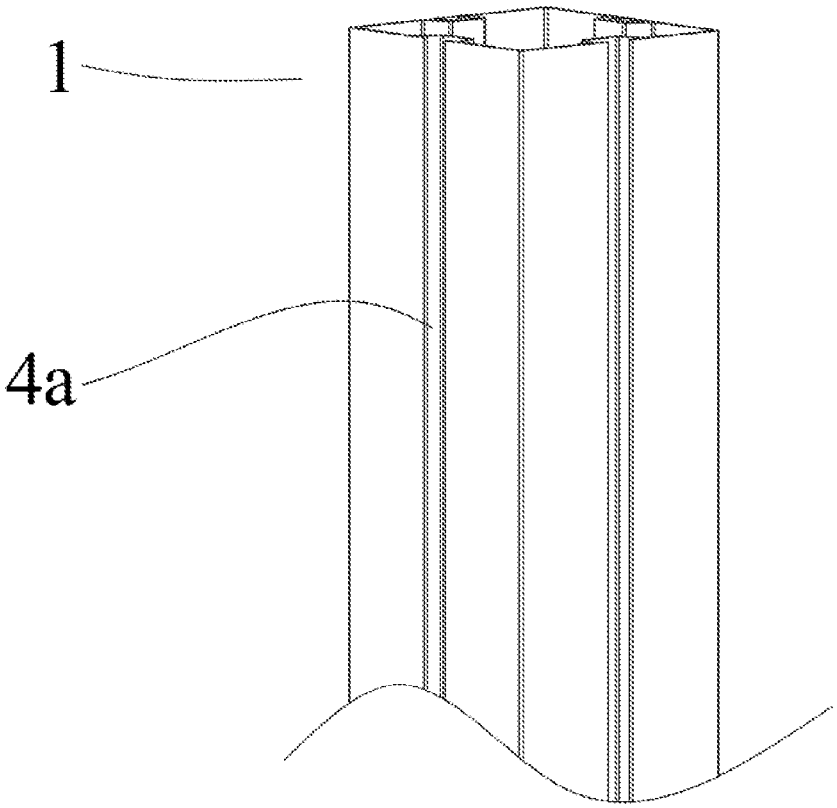
FIG. 2 is a schematic diagram of a stand column structure according to the present invention.

In a preferable solution, with reference to FIG. 2, the assembly slots 4*a* are disposed at centers of four sides of the stand column 1, such that in a subsequent process of assembling the stand column 1, a plurality of sides of the stand column can be extended in a plurality of directions as required.

In a preferable solution, according to a use requirement, corresponding assembly slots 4*b* may be disposed on the ring beam 2. Especially, to reinforce and fix the ring beam 2, two parallel assembly slots 4*b* are generally provided on at least one side surface of the ring beam 2, such that the ring beams are docked by using the docking fastening insert member 61. By using such a double-slot structure, the stability can be reinforced. In addition, the assembly slots 4*b* are further disposed on an upper surface and a lower surface of the ring beam 2 respectively, and are configured to help the connection and mounting of the expansion unit 8 or the other reinforcing components, while facilitating cooperatively mounting the component in the canopy 3 with the ring beam 2.

In the present invention, the assembly slot 4 structures are optimally designed, and are combined on the stand columns 1 and the ring beams 2. In addition, by using different connection components and cooperation relationships with the assembly slots 4, the stand columns 1 and the ring beams 2 can be combined and mounted quickly, the components of the ring beams 2 can also be docked and mounted, and different expansion units 8 can be combined and mounted, to assemble tents with different functions.

Embodiment 2

Based on Embodiment 1, with reference to FIGS. 4 to 16, this embodiment discloses a mounted structure of the stand columns and the ring beams in the tent frame. The structure includes a first connection component 5, The first connection component 5 is configured to fix and mount the stand column 1 and the ring beam 2. The first connection component 5 includes a plurality of fastening insert members 51 and assembly members. Because the assembly member has a different function and a plurality of assembly components, the assembly member may include a single component. The quantity of the assembly components may be set according to a different mounting requirement. The fastening insert member 51 includes a fastening insert part 511 and a fixing part 512. The fastening insert part 511 is configured to match with the slot cavity 41. The fixing part 512 is configured to match with the open slot 42. An outer surface of the fixing part 511 is provided with a fixed hole 513. The fixed hole 513 is a through hole.

A plurality of fastening insert members 51 are provided as general components. In a specific mounting process, according to the mounting position and a corresponding requirement of a to-be-mounted assembly member, the length of the fastening insert member 51 may be adjusted and selected. The fastening insert member 51 may be drawn into a specified position along the slot cavity 41 from the opening position of the end face of the stand column 1 or the ring beam 2. Docking is implemented by using assembly members with different functions, such that quick assembling and mounting can be implemented by using the assembly slots 4 and the other components through the fastening insert members 51. In this case, according to a requirement of the mounting position, an alignment hole is provided on the short side of the slot cavity 41 of the assembly slot 4, to locate and fix the position. After the fastening insert part in the fastening insert member 51 matches with the slot cavity 42, it cannot be disengaged from the open slot 42. The fixing part 512 matched with the open slot 42 is beneficial the matching for other components. Preferably, the fixing part 512 partially protrudes from the open slot 42, and extends outside, or the outer surface of the fixing part 512 and the outer surface of the open slot 42 are at a same level. In a specific mounted structure, the fixed hole 513 is generally a through hole, and therefore is conveniently aligned with the alignment hole in the assembly slot 4, such that the tent structure is mounted and fixed by using screws or bolts. Generally, two or more fixed holes 513 are provided.

A specific mounted structure of the stand columns 1 and the ring beams 2 further includes an assembly member, which may include a plurality of components according to different mounting positions and requirements. Specifically, the assembly member includes a ring-beam inner liner 52, a first anchor member 54, and a second anchor member 55. The ring-beam inner liner 52 is embedded at one end of the ring beam 2, until an end face of the ring-beam inner liner 52 and the end face of the ring beam 2 are at the same level. The first anchor member 54 is embedded in the ring-beam inner liner 52. In addition, an anchor head 541 protrudes from the end face of the ring-beam inner liner 52. An anchor embedding slot cavity configured to match with the first anchor member 54 is disposed in the ring-beam inner liner 52. In addition, an inner limit hole 521 is disposed in the ring-beam inner liner 52. The inner limit hole 521 communicates with the anchor embedding slot cavity. An outer limit hole 21 corresponding to the inner limit hole 521 is disposed on the ring beam 2. In a mounted structure, an assembly docking hole is disposed on the second anchor member 55. The second anchor member 55 penetrates through the outer limit hole 21 and the inner limit hole 521. After the first anchor member 54 is embedded, it penetrates through the assembly docking hole on the second anchor member 55, to implement the whole mounting and fixing. In another mounted structure, the alignment hole in the first anchor member 54 matches with the inner limit hole 521 correspondingly. In this case, a docking hole is disposed on a part of the first anchor member 54 embedded in the ring-beam inner liner 52. After the first anchor member 54 is embedded, the outer limit hole 21, the inner limit hole 521, and the docking hole communicate. By enabling the second anchor members 55 to penetrate the outer limit holes 21, the inner limit holes 521, and the docking holes, various components are docked and mounted, and the assembly members and the ring beams 2 are cooperatively mounted. In this case, the anchor head 541 of the first anchor member 54 is configured to enter the assembly slot 4*a* from the opening of the upper end face of the stand column 1, to be embedded with the assembly slot 4*a*, such the ring beams 2 are cooperatively docked with the stand column 1.

To strengthen the mounting stability of the ring beams 2 and the stand columns 1, a third connection component unit is added to reinforce and mount the ring beams 2. Specifically, the third connection component unit further includes an angle-iron member 56. In this embodiment, the first connection component unit includes a single fastening insert member 51. The second connection component unit includes a single fastening insert member 51. The corresponding size of the fastening insert member 51 may be selected according to the mounting position. The upper end face and the side end face of the angle-iron member 56 match with the fixing parts 512. The fixing parts 512 are a fixing part 512 on a fastening insert member 51 configured to be cooperatively mounted with the ring beam 2 and a fixing part 512 on a fastening insert member 51 configured to be cooperatively mounted with the stand column 1, respectively. The upper end face and the side end face of the angle-iron member 56 are each provided with a first matching hole thereon, and a reinforcing plate for tilting reinforcement. In a preferable embodiment, the first matching hole generally includes a round hole and a racetrack hole. The round hole is configured to match with a fixed hole 513 on the fixing part 512 first. The racetrack hole can be aligned with the fixed hole 513 on another fixing part 512, to increase assembly allowance. Through the fixing of the fastening bolts, the angle-iron member 56 can reinforce, support, and fix the ring beams 2 and the lower parts of the stand columns 1.

In this case, to strengthen the mounting stability of the ring beams 2 and the stand columns 1, the third connection component unit is added to reinforce and mount the ring beams 2. The ring beams 2 arranged at 90° on both sides of the stand column 1 are connected and strengthened. Specifically, the third connection component unit further includes a reinforcing rod 53. In this embodiment, the first connection component unit 1 includes two fastening insert members 51 with different lengths. The second connection component unit also includes two fastening insert members 51 with different lengths. The corresponding size of the fastening insert member 51 may be selected according to the mounting position. The two fastening insert members 51 with different lengths are fixedly mounted with second matching holes at ends of the reinforcing rod 53. Two ends of the reinforcing rod 53 are cooperatively mounted with the fixing parts 512 respectively. The fixing parts 512 located at the two ends are, respectively, fixing parts 512 on fastening insert members 51 correspondingly mounted with the assembly slots 4*b* on upper surfaces of two adjacent ring beams 2 in cooperation at two sides of the stand column 1. The second matching holes are disposed at both ends of the reinforcing rod 53. Preferably, the second matching hole may include two round holes, or a round hole and a racetrack hole. By using the fastening bolt, the second matching hole can match with the fastening insert member 51 cooperatively mounted with the assembly slot 4*b* at the top of the ring beam 2. By using the fastening bolt and enabling the fixed hole 513 in the fixing part 512 to be aligned with the second matching hole, ring beams 2 docked in cooperation at two sides of a stand column 1 are reinforced and fixed. In another embodiment, the first connection component unit further includes a single relatively long fastening insert member 51. The second connection component unit also includes a single relatively long fastening insert member 51. The corresponding size of the fastening insert member 51 may be selected according to a mounting position. The fastening insert member 51 is fixedly mounted with the second matching hole at one end of the reinforcing rod 53. Two ends of the reinforcing rod 53 are respectively cooperatively mounted with fixing parts 512. The fixing parts 512 located at the two ends are, respectively, fixing parts 512 on fastening insert members 51 correspondingly mounted with the assembly slots 4*b* on side surfaces of two adjacent ring beams 2 in cooperation at two sides of the stand column 1.

To further enhance the mounting stability of the column 1, preferably, a stand column inner liner 11 is disposed at the top of the stand column 1. The stand column inner liner 11 is configured to be embedded in an inner cavity of the stand column 1. An end cover plate 12 is disposed on the upper surface of the stand column inner liner 11. The stand column inner liner 11 is usually injection-molded with a plastic material, and is configured to fill the upper part of the stand column 1, thereby making the upper part of the stand column 1 more stable.

In a preferable embodiment, due to the size of the tent frame 7, the ring beam 2 located between two stand columns 1 is usually formed by docking two ring beam units 22. The ring beams 22 are cooperatively mounted by using a second connection component 6. The second connection component 6 includes a docking fastening insert member 61 and a reinforcing plate 62. The docking fastening insert member 61 includes a docking fastening insert part 611 and a docking fixing part 612. The docking fastening insert part 611 is configured to match with the slot cavity 41. The docking fixing part 612 is configured to match with the open slot 42. A docking fixed hole 613 is disposed on an outer surface of the docking fixing part 612. The docking fixed hole 613 is configured to match with the reinforcing plate 62. A fastener is configured to realize reinforcing and fixing. The docking fastening insert member 61 is configured to be cooperatively mounted with adjacent docked ring beams 2, and the docking fastening insert member 61 is symmetrically mounted in assembly slots 4*b* of two adjacent docked ring beams 2.

Preferably, two assembly slots 4*b* are disposed on the side surface of the ring beam unit 22. The two assembly slots 4*b* are arranged at intervals in parallel. Two docking fastening insert members 61 are provided. A single docking fastening insert member 61 matches with a single assembly slot 4*b*, such that ends of two corresponding ring beam units 22 are docked. Preferably, four docking fixed holes 613 are disposed on the docking fixing part 612 on the docking fastening insert member 61. The docking fixed holes are distributed on a single ring beam unit 22 two by two. The reinforcing plate 62 is of a single plate structure and provided with eight corresponding third matching holes. The third matching hole corresponds to the docking fixed hole 613. The fastening bolt is configured to implement fixing.

In addition, to increase the stability of the docked ring beam units 22, the second connection component further includes a docking ring-beam inner liner 63. The docking ring-beam inner liner 63 is divided into two symmetrical parts, and the two parts are embedded in inner cavities of two docked ring beam units 22 respectively.

In this embodiment, the docked structure of the stand column 1 and the ring beams 2 in the tent frame 7 is optimized, and a docked fixed structure of two ring beam units 22 in the ring beam 2 is also optimized. The docking and mounting are implemented by using the assembly slots 4 in the stand column 1 and the ring beam 2, the first connection component 5, and the second connection component 6, thereby realizing the generality of a mounted structure between components, and making the mounting more convenient and efficient.

Embodiment 3

Based on any one of the foregoing embodiments, with reference to FIGS. 1, 29, 30, and 17 to 25, this embodiment discloses a variously expandable outdoor tent based on an assembly structure for a tent, including a tent frame 7 and a canopy 3 configured to be cooperatively mounted with the tent frame 7. The tent frame 7 includes at least one tent frame unit 71, and a single canopy 3 is cooperatively disposed in a single tent frame unit 71.

In a preferable embodiment, the tent frame 7 includes a single tent frame unit 71, and is formed by four stand columns 1 and four ring beams 2. A single canopy 3 is cooperatively disposed. The canopy 3 is one of a tarpaulin canopy, a louver canopy, a tin canopy, a sun panel canopy, and an umbrella canopy.

Figure 20:
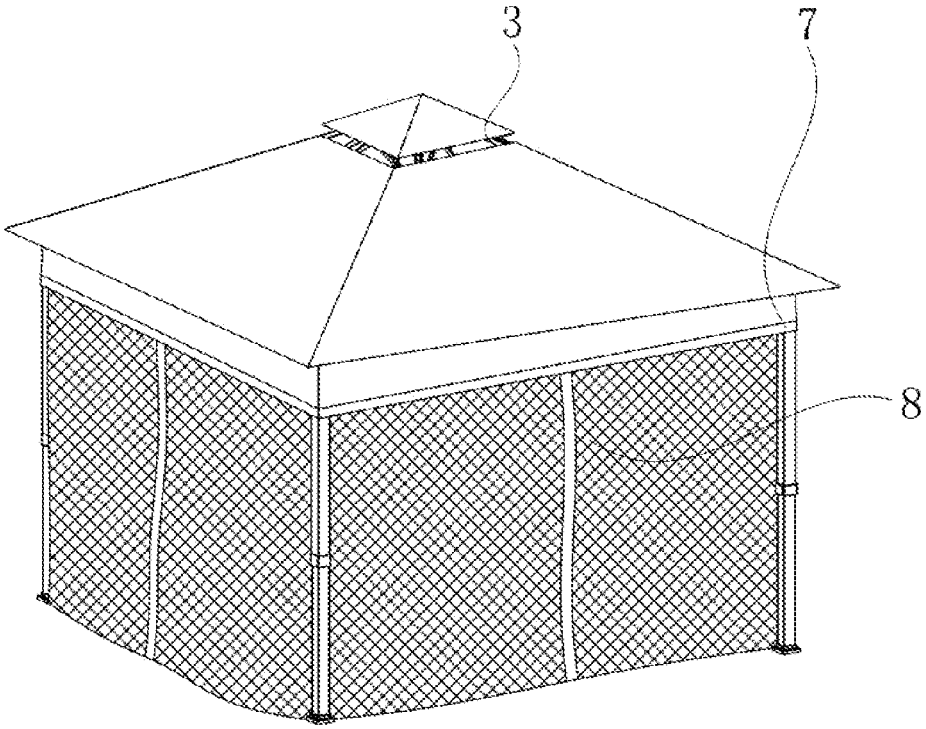
FIG. 20 is a schematic diagram 5 of the entire structure of the outdoor tent according to the present invention.
Figure 21:
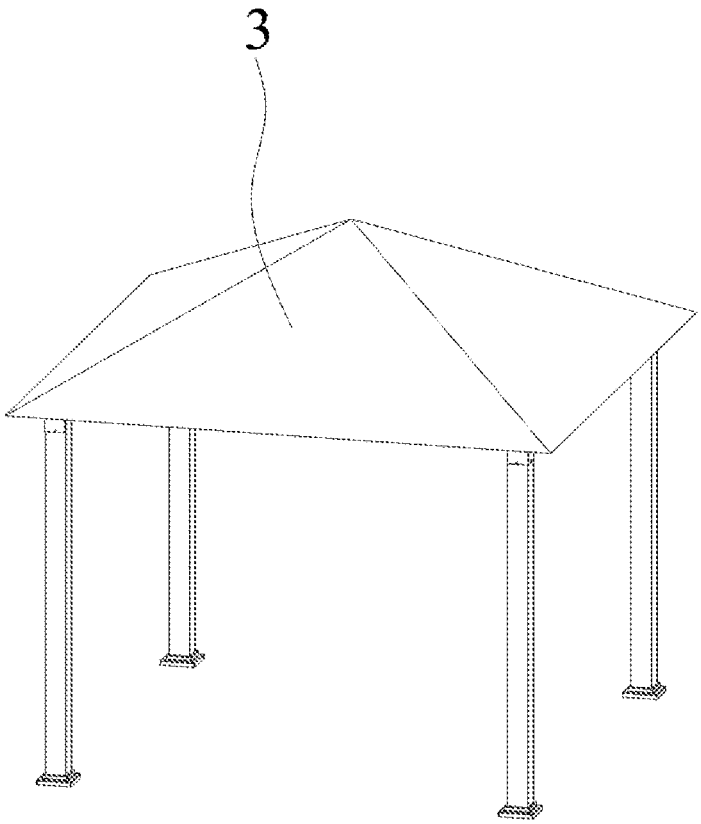
FIG. 21 is a schematic diagram 6 of the entire structure of the outdoor tent according to the present invention.

As shown in FIGS. 1, 20, and 21, in the structure of the canopy 3, a tarpaulin cover is disposed on the top of the tarpaulin canopy, which can be a flat. Specific canopy brackets can be combined with the tarpaulin to form a dome canopy, a roof canopy, and the like. Various selections can be made according to the use requirement.

Figure 17:
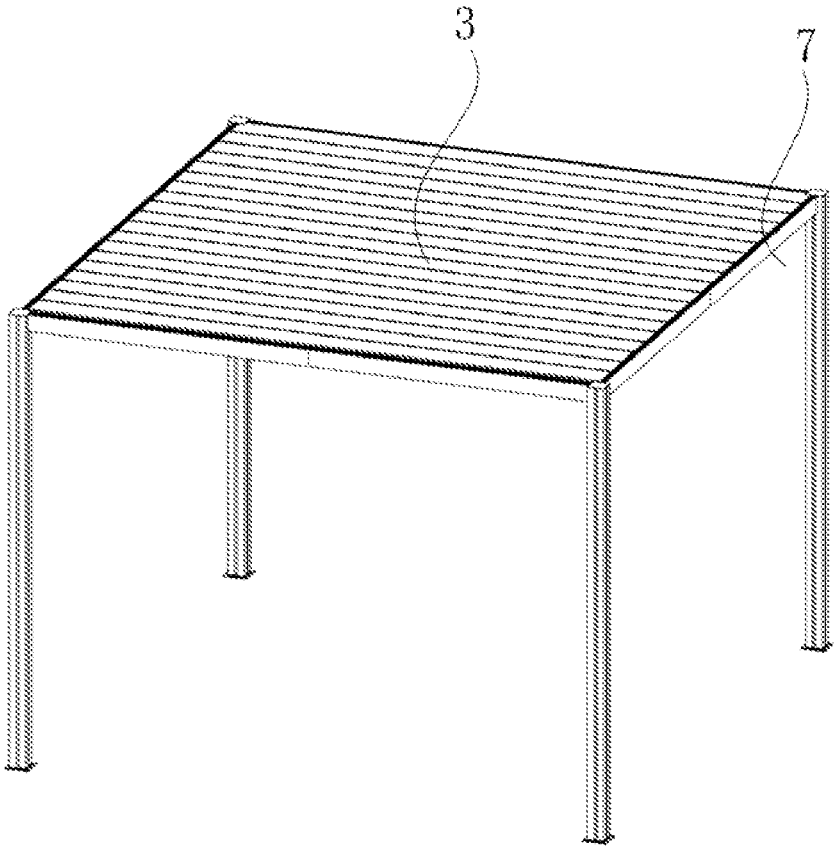
FIG. 17 is a schematic diagram 2 of the entire structure of the outdoor tent according to the present invention.
Figure 18:
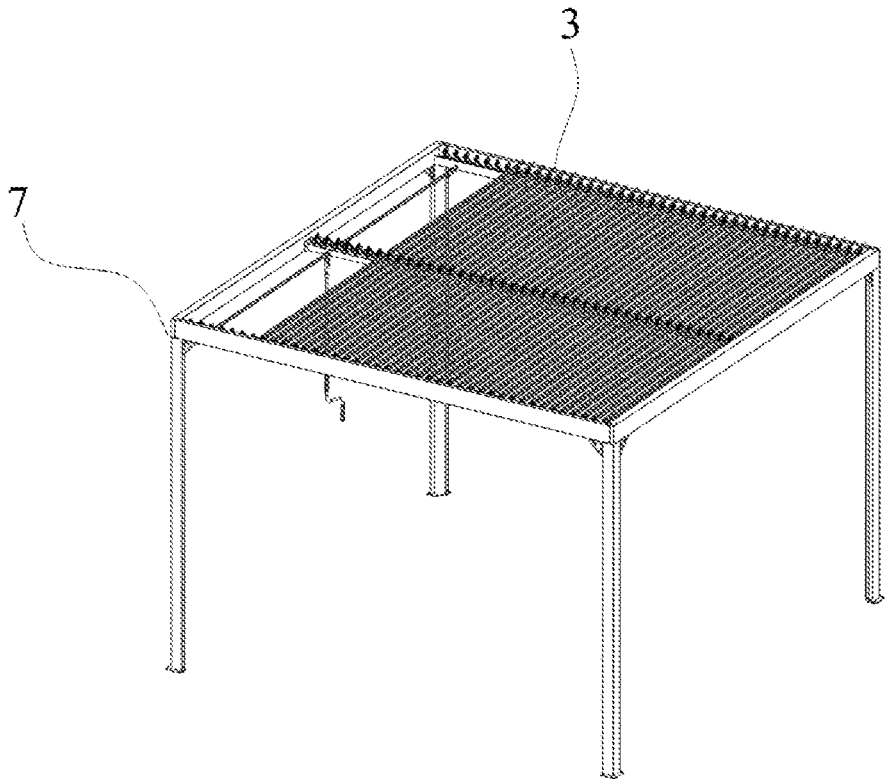
FIG. 18 is a schematic diagram 3 of the entire structure of the outdoor tent according to the present invention.

With reference to FIGS. 17 and 18, in the structure of the canopy 3, the louver canopy is of a structure with openable louvers, which is commonly used in the related art.

Figure 19:
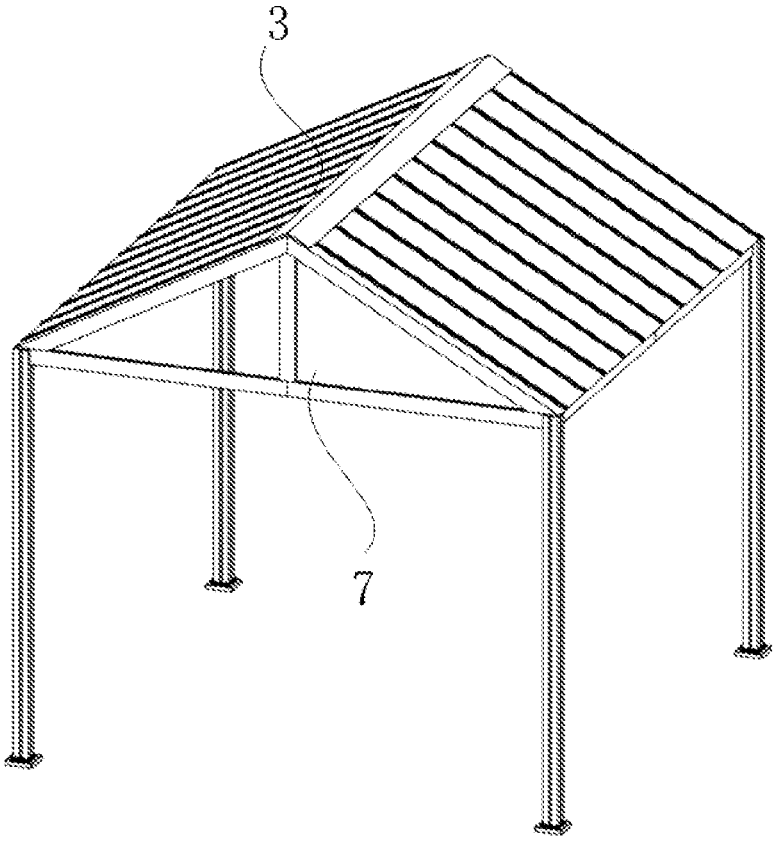
FIG. 19 is a schematic diagram 4 of the entire structure of the outdoor tent according to the present invention.
Figure 22:
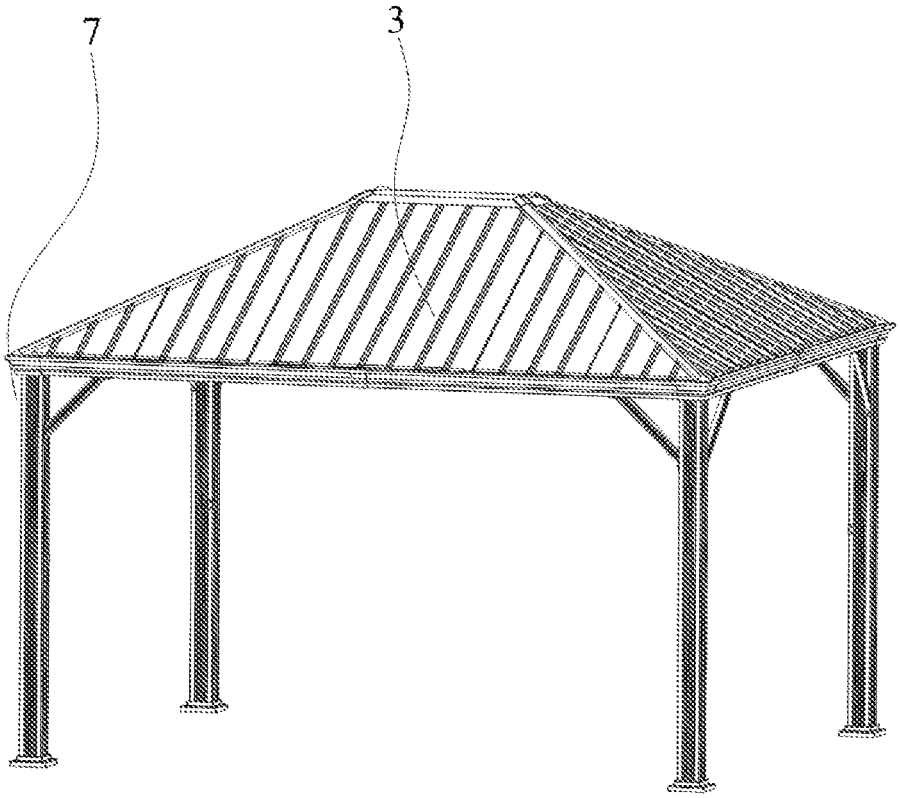
FIG. 22 is a schematic diagram 7 of the entire structure of the outdoor tent according to the present invention.
Figure 23:
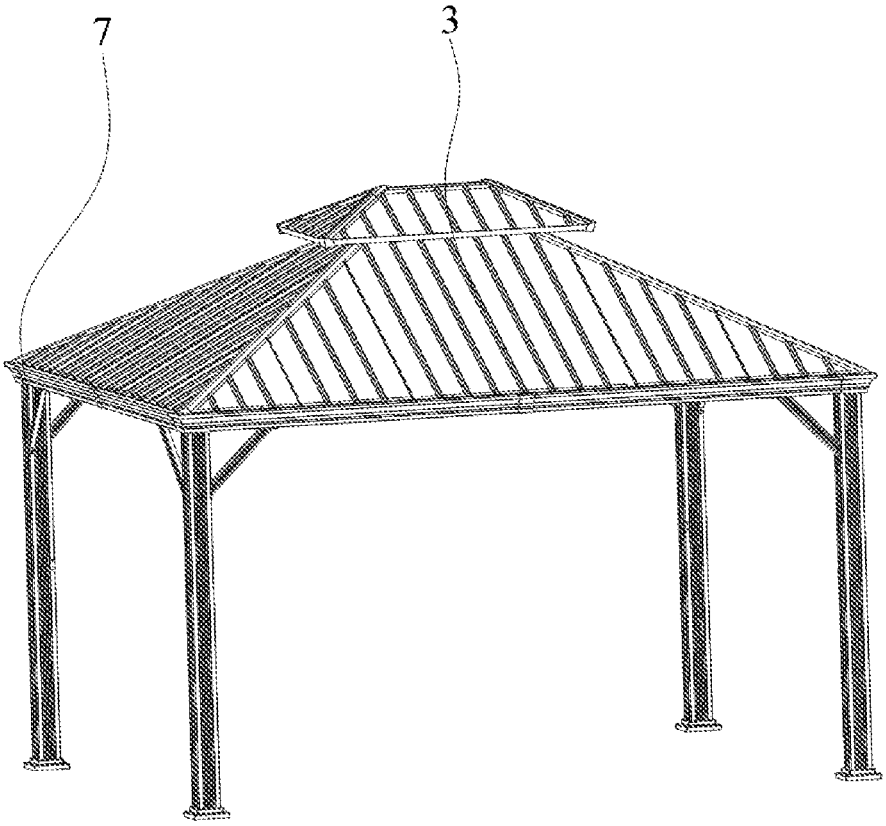
FIG. 23 is a schematic diagram 8 of the entire structure of the outdoor tent according to the present invention.

With reference to FIGS. 19, 22, and 23, in the structure of the canopy 3, the tin canopy is mounted by combining the canopy frame and a tent frame, and is made by clamping iron sheets or fixing the sheets with fasteners, to match with the canopy frame. Alternatively, a double-tin canopy tent may be formed. For the structure of the tin canopy, refer to the design of the common hard canopy structure in the related art.

In the structure of the canopy 3, the sun panel canopy is mounted by combining the canopy frame and a tent frame, and made by clamping sun panels or fixing the sheets with fasteners, to match with the canopy frame. Alternatively, a double-sun panel canopy tent may be formed. For the structure of the sun panel canopy, refer to the design of the common hard canopy structure with the sun panels in the related art. The sun panel is made of a light-transmitting or semi-translucent material, preferably, a plastic material.

Figure 24:
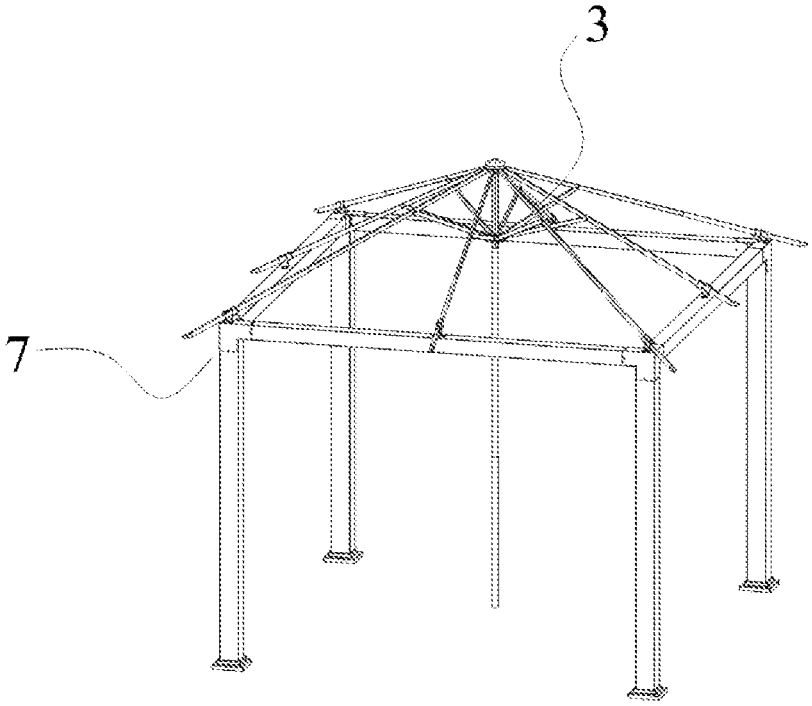
FIG. 24 is a schematic diagram 9 of the entire structure of the outdoor tent according to the present invention.

As shown in FIG. 24, in the structure of the canopy 3, the umbrella canopy is usually of an openable umbrella structure, and is made by combining the umbrella frame and the tent frame, and using the sun shading cloth covering the umbrella canopy.

Figure 25:
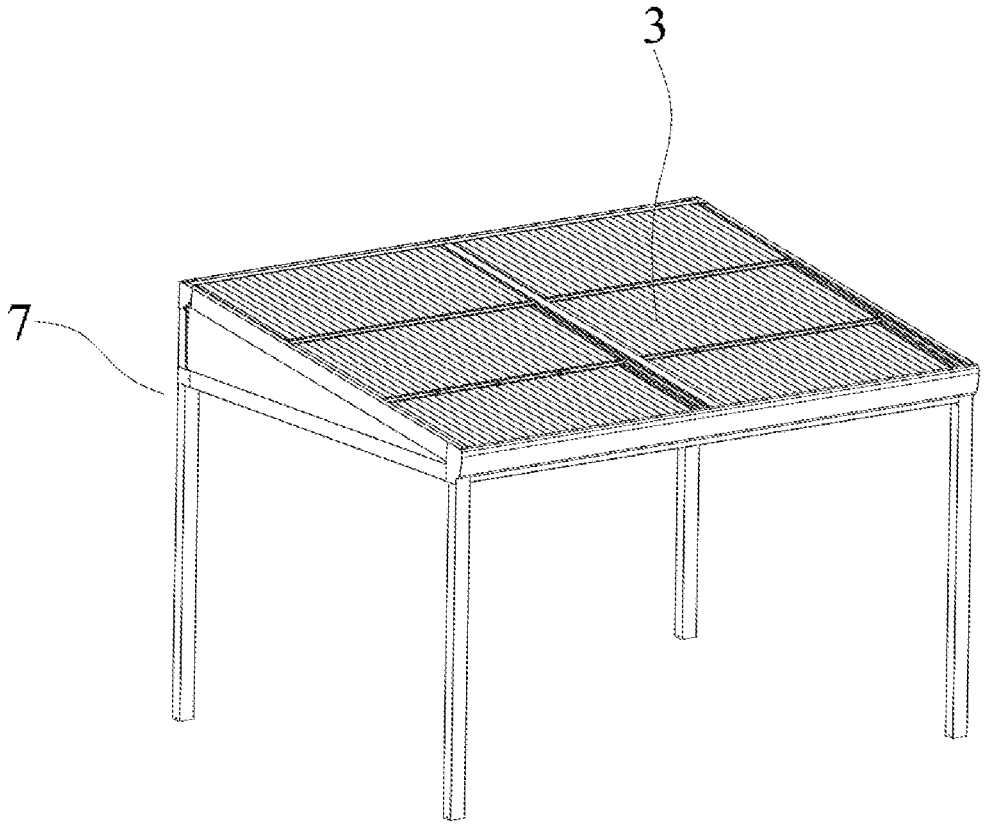
FIG. 25 is a schematic diagram 10 of the entire structure of the outdoor tent according to the present invention.

With reference to FIG. 25, in the structure of the canopy 3, the inclined canopy is usually made with a tilted plane. The upper ends of the two stand columns on one side are heightened by using connection members, such that the canopy is arranged at an inclined angle.

In this embodiment, based on the basic structure of the tent frame 7, different structures of the canopy 3 can be used together to form outdoor tents with different functions. In the design of this embodiment, the outdoor tent can be expanded variously. In this case, the tent frame structure of the present invention can be used to mount the tent frame conveniently and quickly, improving the convenience and feasibility of the various expansion.

Embodiment 4

Figure 26:
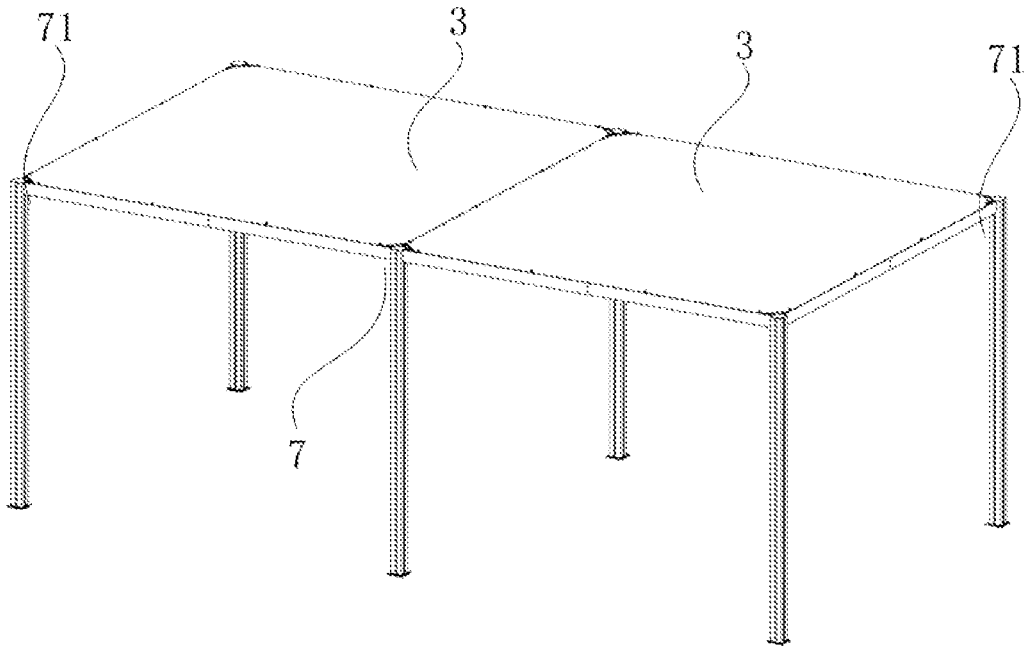
FIG. 26 is a schematic diagram 11 of an entire structure of the outdoor tent according to the present invention.
Figure 27:
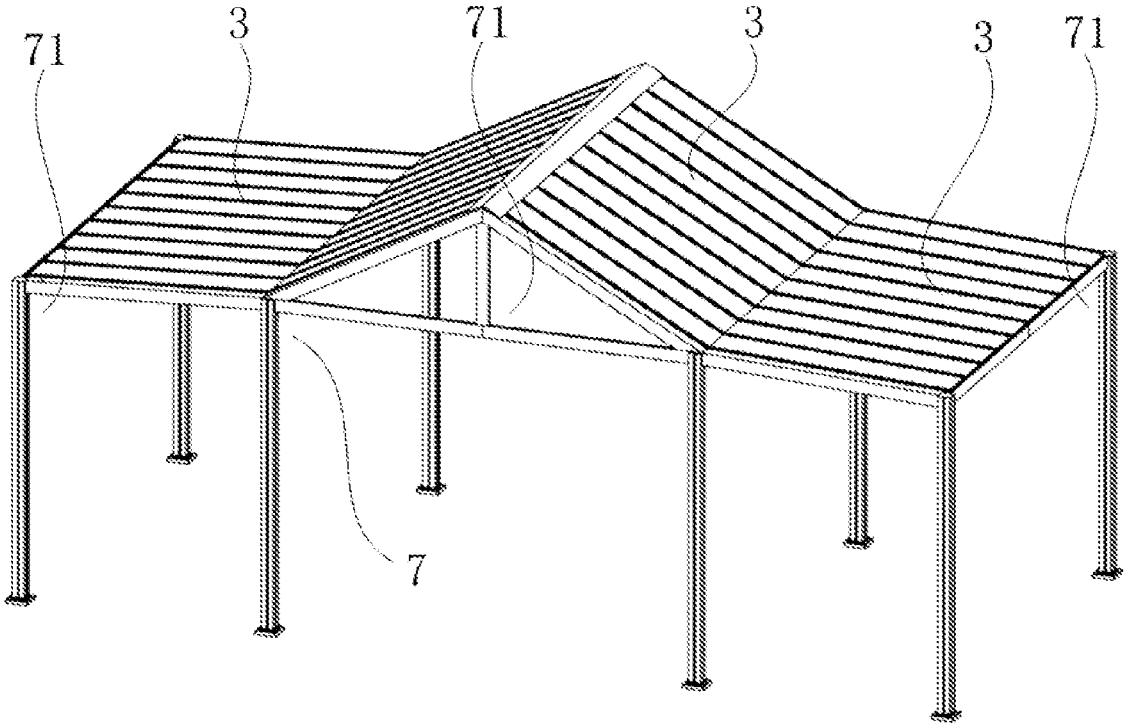
FIG. 27 is a schematic diagram 12 of the entire structure of the outdoor tent according to the present invention.
Figure 28:
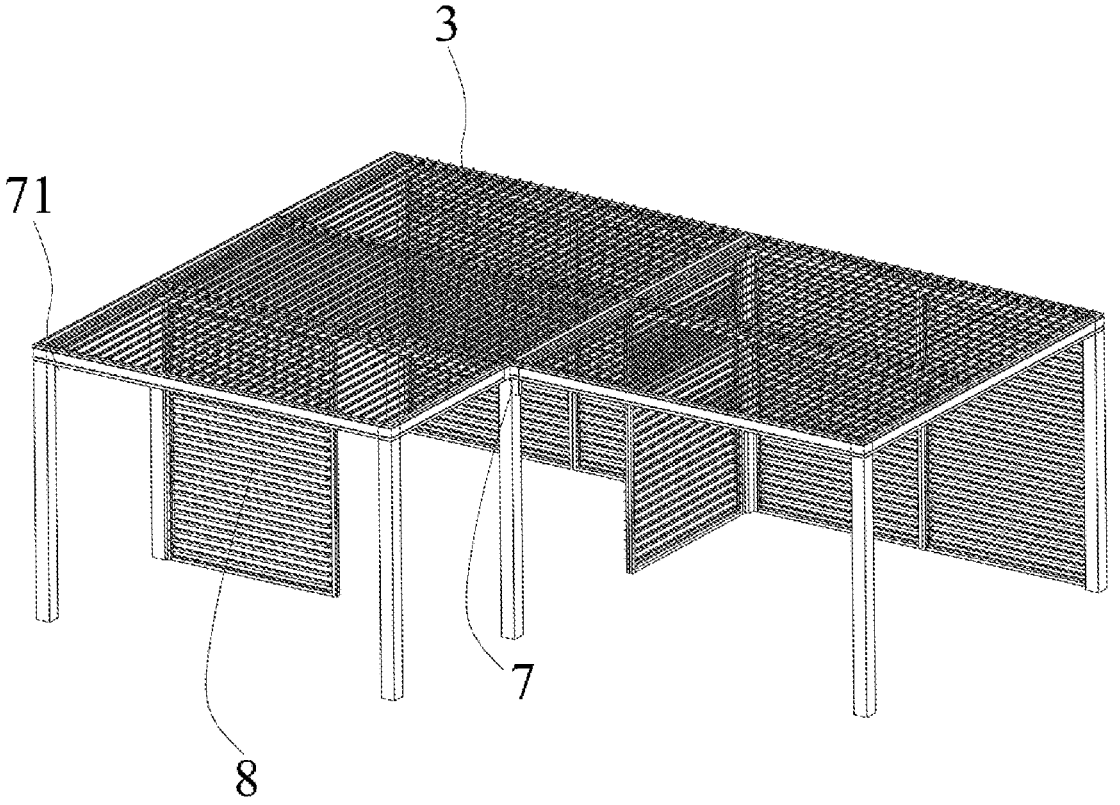
FIG. 28 is a schematic diagram 13 of the entire structure of the outdoor tent according to the present invention.
Figure 29:
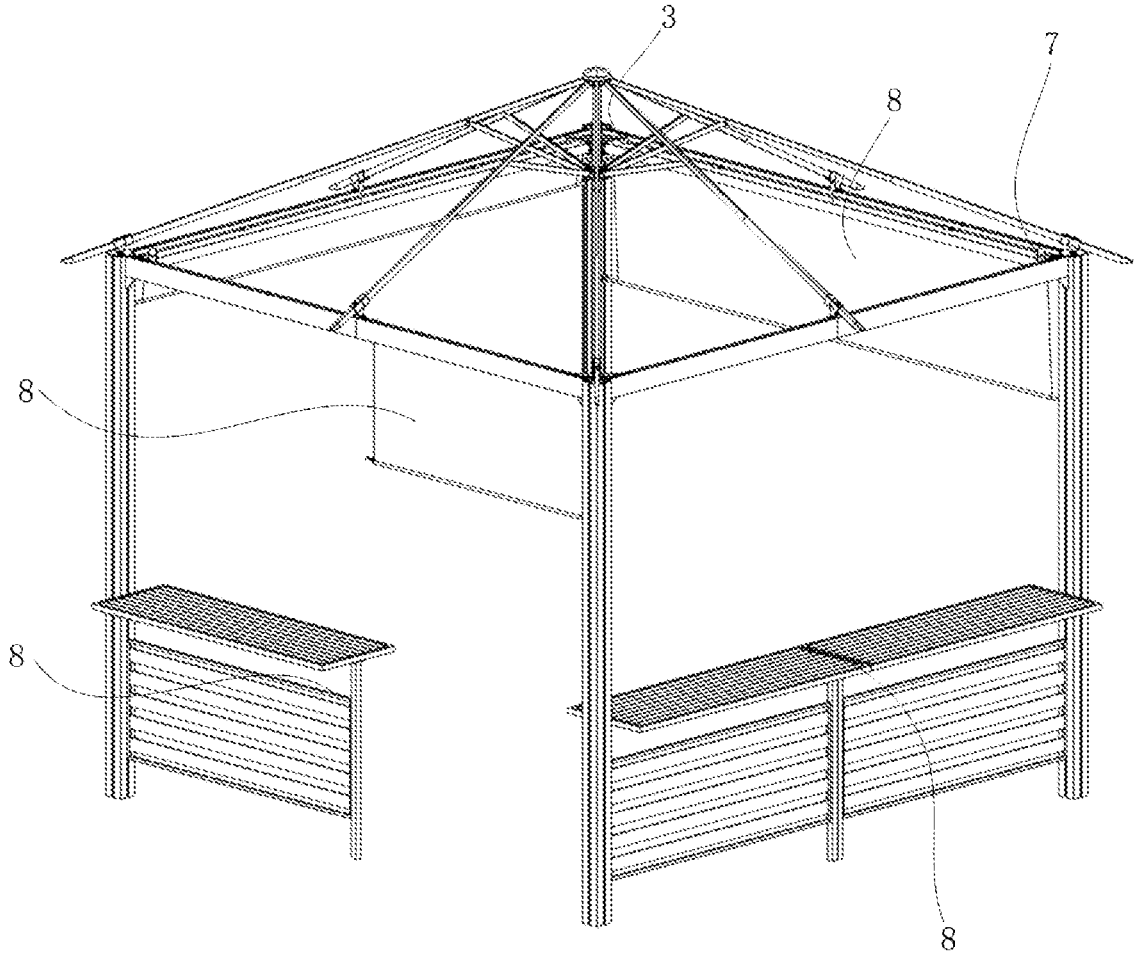
FIG. 29 is a schematic diagram 14 of the entire structure of the outdoor tent according to the present invention.
Figure 30:
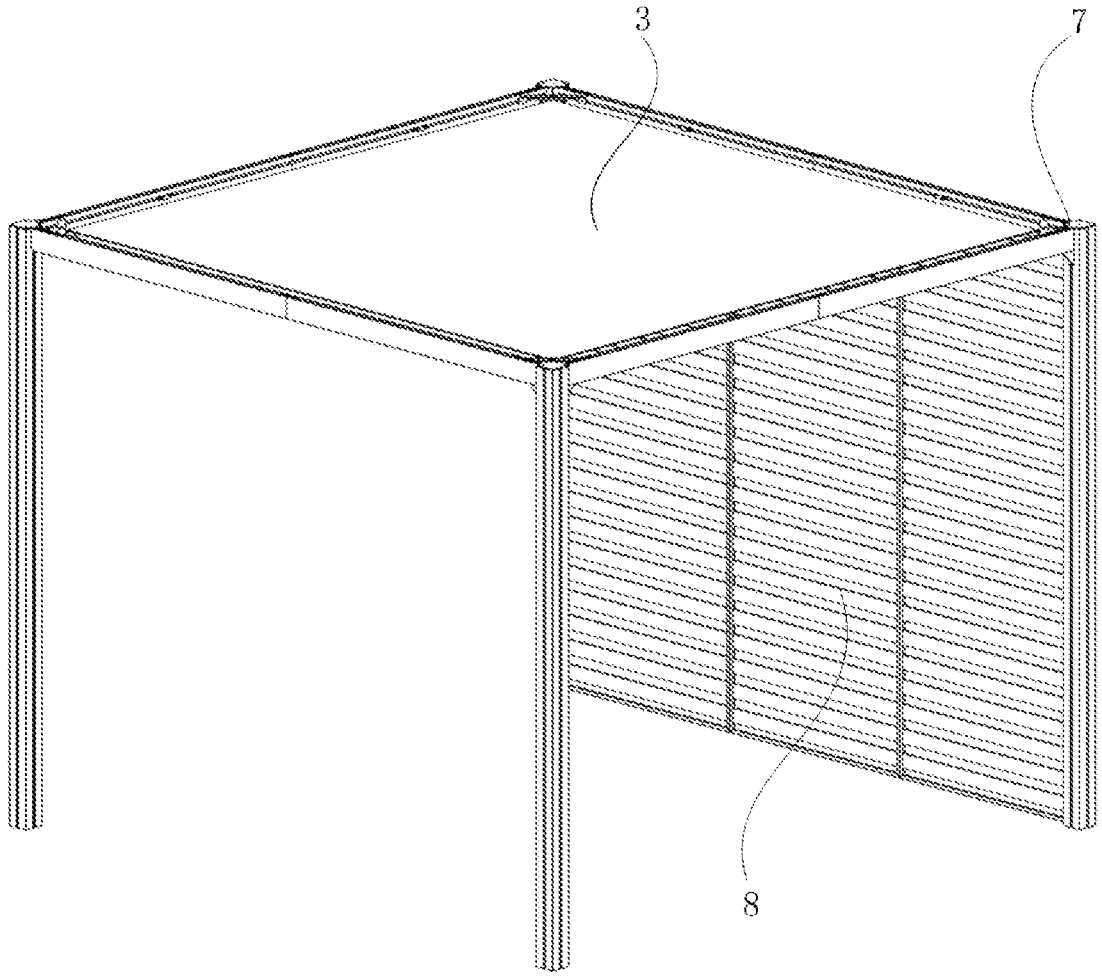
FIG. 30 is a schematic diagram 15 of the entire structure of the outdoor tent according to the present invention.
Figure 31:
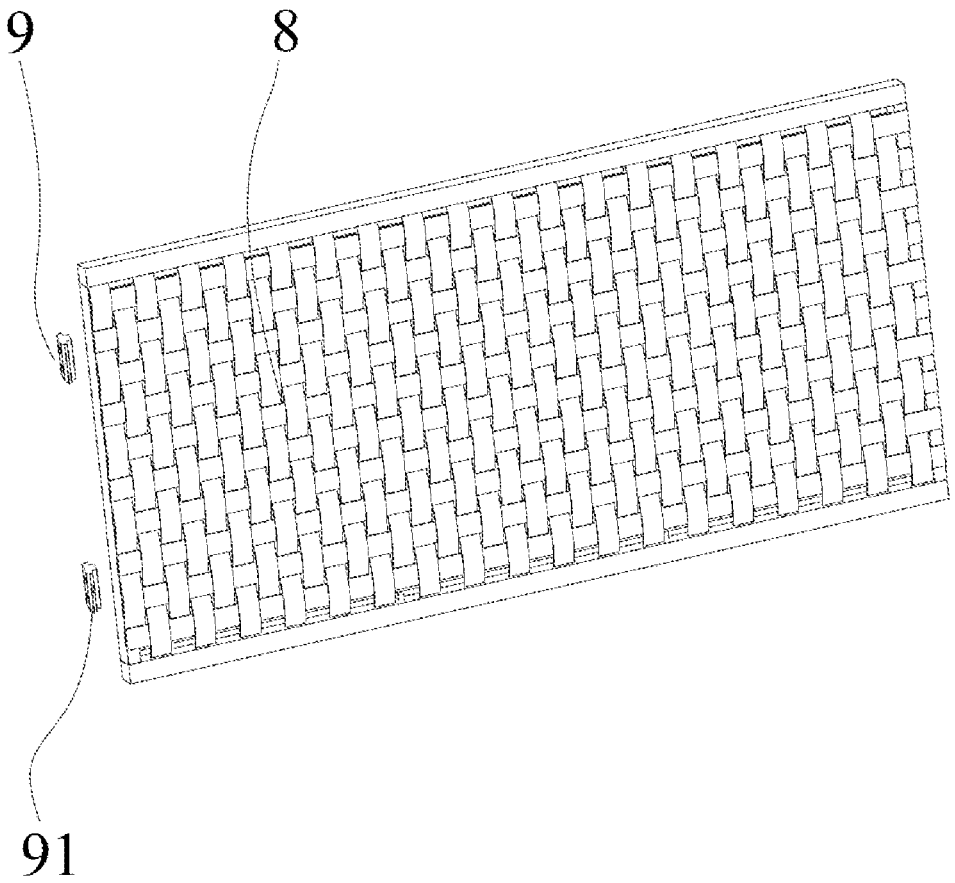
FIG. 31 is a schematic structural diagram 1 of a matched structure of an expansion unit and a third connection component according to the present invention.
Figure 32:
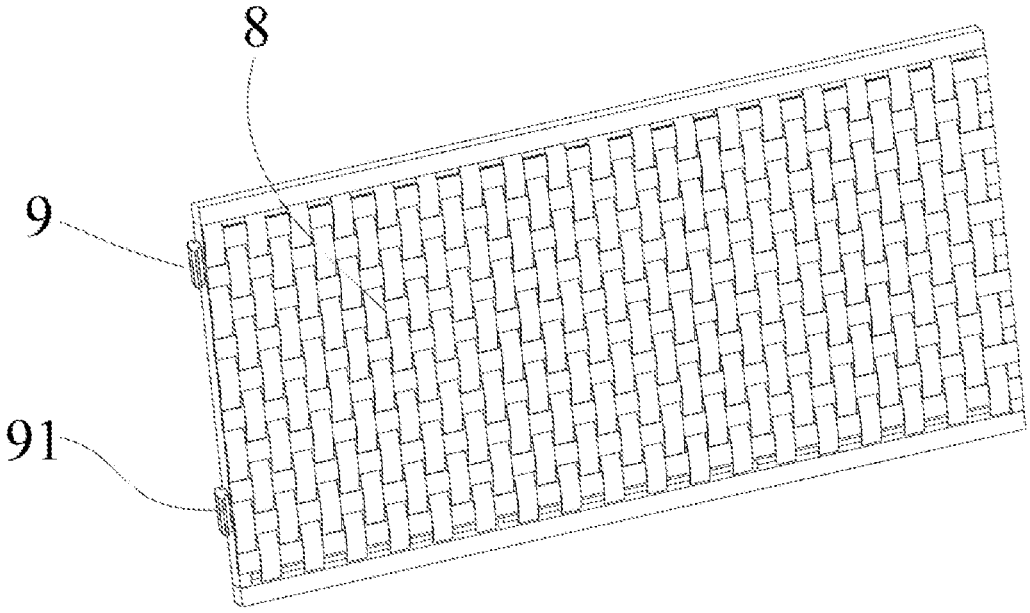
FIG. 32 is a schematic structural diagram 2 of the matched structure of an expansion unit and a third connection component according to the present invention.

Based on any one of the foregoing embodiments, with reference to FIGS. 26 to 28, this embodiment discloses an outdoor tent with a structure of a plurality of tent frame units. The tent frame 7 includes two or more tent frame units 71. Ring beams 2 on a same side of two adjacent tent frame units 71 are cooperatively mounted by using a same stand column 1. A single canopy 3 is cooperatively disposed in a single tent frame unit 71.

According to the use requirement, the canopies 3 in different tent frame units 71 may be of the same canopy structure or different canopy structures, thereby variously expanding tents.

Embodiment 5

Based on any one of the foregoing embodiments, with reference to FIGS. 29 to 32, this embodiment discloses an expandable outdoor tent with expansion units, including at least one expansion unit 8. The expansion unit 8 is cooperatively mounted with the assembly slot 4 by using the third connection component 9. The third connection component 9 includes a clamping member 91. The expansion unit 8 is cooperatively fixed to a fixing mounting part on the clamping member 91 by using the fastener. They may be integrally fixed or welded. The clamping member 91 in the third connection component 9 and the fastening insert member 51 in the first connection component 5 are of similar structures. The clamping member 9 includes a clamping part and the fixing mounting part. The clamping part is configured to match with the slot cavity 41. The fixing mounting part is configured to match with the open slot 42. The fixing mounting part may be fixed to the expansion unit 8 integrally. Alternatively, they may be separate structures. If they are separate structures, the fixing mounting part and the fastening insert member 51 in the first connection component 5 are of a same structure. The length of the fixing mounting part is set correspondingly according to a requirement.

The expansion unit 8 is a functional component. The position of the side cavity of the tent may be selected and assembled according to the use requirement. The structure of the assembly slot 4 is optimally designed, and the quickly-mounted structure formed by using the assembly slot 4 and the third connection component 9 facilitates the combined mounting of the expansion units 8 and makes the products more diverse.

In a preferable embodiment, the expansion unit 8 includes a sunshade shutter. The expansion unit 8 is cooperatively mounted with an assembly slot 4*b* below the ring beam 2 by using the third connection component 9, and the expansion unit 8 is hanged below the ring beam 2, such that sides of the tent are shaded to facilitate the formation of an independent space inside the tent.

In a preferable embodiment, the expansion unit 8 includes a sun-shedding louver, the sun-shedding louver is cooperatively mounted with the assembly slot 4*b* below the ring beam 2 by using the third connection component 9, and the sun-shedding louver is hanged below the ring beam 2, such that sides of the tent are shaded to facilitate the formation of an independent space inside the tent.

In a preferable embodiment, the expansion unit 8 includes a grille assembly. The grille assembly is cooperatively mounted with an assembly slot 4*a* on a stand column 1 by using the third connection component 9. A table board is cooperatively disposed on an upper part of the grille assembly, and at least one side of the table board is cooperatively mounted with the assembly slot 4*a* on the stand column 1 by using the third connection component 9. By combining the foregoing structures, the tent can form a gazebo.

In a preferable embodiment, the expansion unit 8 includes a stool chair, and the stool chair is cooperatively mounted with the assembly slot 4*a* on the stand column 1 by using the third connection component 9.

In a preferable embodiment, the expansion unit 8 includes a decorative panel, and the decorative panel is integrally or separately fixed to the third connection component 9 and is cooperatively mounted with the assembly slot 4*a* of the stand column 1, to decorate the outer surface of the stand column 1, thereby improving the appearance aesthetics.

Based on the above description, the expansion units 8 can be combined freely and variously according to the intention of the user, and a variety of expansion units with different functions can be combined in the tent frame to assemble the outdoor tent variously.

By optimizing the structure of the tent frame and combining different connection components with the assembly slots, the present invention can carry out diversified optional design for the outdoor tent and expand the tent variously.

The above descriptions are only preferable embodiments of the present invention, and do not limit the present invention in any form. Any simple modifications, equivalent changes or modifications made to the above embodiments according to the technical principles of the present invention shall fall into the scope of the technical solutions of the present invention.

The invention claimed is:

1. An assembly structure for a tent, comprising stand columns and ring beams, wherein the stand columns and the ring beams are each provided with at least one assembly slot, the stand columns and the ring beams are capable of being assembled by using first connection components to form a tent frame, each first connection component comprises a first connection component unit configured to be cooperatively mounted with the assembly slot in a respective stand column of the stand columns, a second connection component unit configured to be cooperatively mounted with the assembly slot in a respective ring beam of the ring beams, and a third connection component unit configured to dock the first connection component unit and the second connection component unit, wherein the at least one assembly slot of each of the stand columns and the ring beams comprises a slot cavity and an open slot penetrating through the slot cavity, limiting plates are disposed at two sides of the open slot, and a part of the slot cavity adjacent to the open slot is wider than the open slot, the assembly structure further comprising a plurality of fastening insert members, each fastening insert member is configured to be received by the at least one assembly slot and comprises a fastening insert part and a fixing part, each fastening insert part is configured to be received by the slot cavity, and the fixing part is configured to be received by the open slot, an outer surface of the fixing part is provided with a fixed hole, and wherein the first connection component unit comprises one of the plurality of fastening insert members that is configured to be received by the assembly slot in the respective stand column, the second connection component unit comprises another one of the plurality of fastening insert members that is configured to be received by the assembly slot in the respective ring beam, and the third connection component unit is configured to perform cooperative mounting the one of the plurality of fastening insert members of the first connection component unit with the another one of the plurality of fastening insert members of the second connection component unit.

2. The assembly structure for a tent according to claim 1, further comprising a plurality of assembly members, wherein each assembly member of the plurality of assembly members comprises a ring-beam inner liner, a first anchor member, and a second anchor member, the ring-beam inner liner being embedded in and mounted at one end of the respective ring beam, the first anchor member being embedded and mounted in the ring-beam inner liner, wherein an anchor head of the first anchor member protrudes from an end face of the ring-beam inner liner, the anchor head is configured to be cooperatively embedded with the assembly slot in the respective stand column, an inner limit hole is provided on the ring-beam inner liner, an outer limit hole corresponding to the inner limit hole is disposed on the respective ring beam, and the second anchor member is configured to penetrate through the outer limit hole and the inner limit hole, to engage the first anchor member.

3. The assembly structure for a tent according to claim 1, wherein the third connection component unit comprises an angle-iron member, wherein an upper end face and a side end face of the angle-iron member engage the fixing part on each fastening insert member configured to be cooperatively mounted with the respective ring beam and the fixing part on each fastening insert member configured to be cooperatively mounted with the respective stand column, respectively.

4. The assembly structure for a tent according to claim 3, wherein the at least one assembly slot comprises two assembly slots disposed on two side of the respective stand column, respectively, and wherein the third connection component unit comprises a reinforcing rod, two ends of the reinforcing rod are configured to be cooperatively mounted with the fixing part of each of two fastening insert members respectively mounted on two adjacent ring beams in cooperation at the two sides of the respective stand column.

5. The assembly structure for a tent according to claim 2, wherein a top of the respective stand column is cooperatively provided with a stand column inner liner configured to be embedded in an inner cavity of the respective stand column, and an upper surface of the stand column inner liner is provided with an end cover plate.

6. The assembly structure for a tent according to claim 1, wherein one of the ring beams located between two adjacent stand columns is formed by docking two ring beam units, the two ring beam units are cooperatively mounted by using a second connection component comprising a docking fastening insert member, a reinforcing plate, and a docking ring-beam inner liner, the docking fastening insert member comprises a docking fastening insert part and a docking fixing part, the docking fastening insert part is configured to be received by the slot cavity, the docking fixing part is configured to be received by the open slot, an outer surface of the docking fixing part is provided with a docking fixing hole for connection with the reinforcing plate, the docking ring-beam inner liner is divided into two symmetrical parts, and the two symmetrical parts are embedded in inner cavities of the docked two ring beam units respectively.

7. The assembly structure for a tent according to claim 6, wherein the docking fastening insert member is symmetrically mounted in assembly slots of the docked two ring beam units.

8. The assembly structure for a tent according to claim 1, wherein each of the stand columns has four sides, and the at least one assembly slot comprises one assembly slot on each of the four sides.

9. A variably expandable outdoor tent comprising: at least one of the tent frame according to claim 1, and a single canopy configured to be cooperatively mounted with the at least one of the tent frame.

10. The variably expandable outdoor tent according to claim 9, wherein the canopy comprises one or more of a tarpaulin canopy, a louver canopy, a tin canopy, a sun panel canopy, an umbrella canopy, and an inclined canopy.

11. The variably expandable outdoor tent according to claim 10, wherein the at least one of the tent frame comprises two or more tent frames, and respective ring beams of the ring beams, at a same side, of two adjacent tent frames are cooperatively mounted to a common stand column.

12. The variably expandable outdoor tent according to claim 9, further comprising at least one expansion unit, wherein the expansion unit is cooperatively mounted with the at least one assembly slot in one of the stand columns by using a third connection component.

13. The variably expandable outdoor tent according to claim 12, wherein the third connection component comprises a clamping member, and the expansion unit is cooperatively fixed to a fixing part on the clamping member by using a fastener.

14. The variably expandable outdoor tent according to claim 13, wherein the expansion unit comprises a sunshade shutter, the expansion unit is cooperatively mounted with the assembly slot in the respective ring beam by using the third connection component, and the expansion unit is hanged below the respective ring beam.

15. The variably expandable outdoor tent according to claim 13, wherein the expansion unit comprises a sun-shedding louver, the sun-shedding louver is cooperatively mounted with the assembly slot in the respective ring beam by using the third connection component, and the sun-shedding louver is hanged below the respective ring beam.

16. The variably expandable outdoor tent according to claim 13, wherein the expansion unit comprises a grille assembly, and the grille assembly is cooperatively mounted with the at least one assembly slot in one of the stand columns by using the third connection component.

17. The variably expandable outdoor tent according to claim 16, wherein a table board is cooperatively disposed on an upper part of the grille assembly, and at least one side of the table board is cooperatively mounted with the at least one assembly slot in one of the stand columns by using the third connection component.

18. The variably expandable outdoor tent according to claim 13, wherein the expansion unit comprises a stool chair, and the stool chair is cooperatively mounted with the at least one assembly slot in one of the stand columns by using the third connection component.

19. The variably expandable outdoor tent according to claim 13, wherein the expansion unit comprises a decorative panel, and the decorative panel is integrally or separately fixed to the third connection component and is cooperatively mounted with the at least one assembly slot in one of the stand columns.

* * * * *